US006449878B1

(12) United States Patent
Lyden

(10) Patent No.: US 6,449,878 B1
(45) Date of Patent: Sep. 17, 2002

(54) ARTICLE OF FOOTWEAR HAVING A SPRING ELEMENT AND SELECTIVELY REMOVABLE COMPONENTS

(76) Inventor: Robert M. Lyden, 18261 SW. Fallatin Loop, Aloha, OR (US) 97707

( * ) Notice: Subject to any disclaimer, the term of this patent is extended or adjusted under 35 U.S.C. 154(b) by 0 days.

(21) Appl. No.: 09/523,341

(22) Filed: Mar. 10, 2000

(51) Int. Cl.[7] ..... A43B 13/28
(52) U.S. Cl. ..... 36/27; 36/38
(58) Field of Search ..... 36/27, 28, 30 R, 36/38, 7.8

(56) References Cited

U.S. PATENT DOCUMENTS

| | | | | |
|---|---|---|---|---|
| 75,900 A | | 3/1868 | Hale et al. | 36/28 |
| RE9,618 E | | 3/1881 | Nichols | 36/27 |
| 298,844 A | | 6/1884 | Glanville | |
| 318,366 A | | 5/1885 | Fitch | |
| 324,065 A | | 8/1885 | Andrews | 36/37 |
| 337,146 A | | 3/1886 | Gluecksmann | 36/7.8 |
| 357,062 A | * | 2/1887 | Buch | |
| 413,693 A | | 10/1889 | Walker | |
| 418,922 A | | 1/1890 | Minahan | |
| 427,136 A | | 5/1890 | Walker | 36/7.8 X |
| 620,582 A | | 3/1899 | Goff | |

(List continued on next page.)

FOREIGN PATENT DOCUMENTS

| | | | |
|---|---|---|---|
| AT | 33492 | 6/1908 | |
| CA | 1115950 | 1/1982 | 36/6 |
| CH | 425537 | 5/1967 | |
| DE | 59317 | 3/1891 | |
| DE | 620963 | 10/1935 | |
| DE | 2419870 | 11/1974 | |
| DE | 250156 | 7/1976 | A43B/13/26 |
| DE | 2543268 a1 | 3/1977 | A43C/15/16 |
| DE | 2851535 A1 | 4/1980 | A43B/13/26 |
| DE | 2851571 A1 | 5/1980 | A43B/13/26 |

(List continued on next page.)

OTHER PUBLICATIONS

Runner's World, Fall 2000 Shoe Buyer's Guide, Sep., 2000.
Patent application No. 09/228,206, filed Jan. 11, 1999 by Robert M. Lyden entitled "Wheeled Skate with Step–in Binding and Brakes".
Patent application No. 09/570, 171, filed May 11, 2000, by Robert M. Lyden entitled "Light Cure Conformable Device for Articles of Footwear and Method of Making the same".
8 Photos of NIKE Secret Prior Art Published Oct., 2000.
2 Pages, DuPont Website Information Re:ZYTEL© and Nike Track Shoes dated Feb. 2, 2001, published Oct., 2000.
K. J. Fisher, "Advanced Composites Step into Athletic Shoes," *Advanced Composites*, May/Jun. 1991, pp. 32–35.
Product Literature from L.A. Gear regarding the Catapult Shoe Design.
*Discovery*, Oct. 1989, pp. 77–83, Kunzig.

*Primary Examiner*—Ted Kavanaugh
(74) *Attorney, Agent, or Firm*—Westman, Champlin & Kelly, P.A.

(57) ABSTRACT

The article of footwear taught in the present invention includes a spring element which can provide improved cushioning, stability, running economy, and a long service life. Unlike the conventional foam materials presently being used by the footwear industry, the spring element is not substantially subject to compression set degradation and can provide a relatively long service life. The components of the article of footwear including the upper, insole, spring element, and outsole portions can be selected from a range of options, and can be easily removed and replaced, as desired. Further, the relative configuration and functional relationship as between the forefoot midfoot areas of the article of footwear can be readily modified and adjusted. Accordingly, the article of footwear can be customized by a wearer or specially configured for a select target population in order to optimize desired performance criteria.

30 Claims, 9 Drawing Sheets

U.S. PATENT DOCUMENTS

| | | | | | |
|---|---|---|---|---|---|
| 622,673 | A | | 4/1899 | Ferrata | |
| 641,642 | A | | 1/1900 | Gunn | |
| 733,167 | A | | 7/1903 | Denton | 36/37 X |
| 854,274 | A | | 5/1907 | Crook et al. | |
| 871,864 | A | | 11/1907 | Feazell et al. | |
| 927,831 | A | | 7/1909 | Crane | |
| 1,022,672 | A | | 4/1912 | Hammer | 36/37 X |
| 1,043,350 | A | | 11/1912 | Owers | |
| 1,080,781 | A | | 12/1913 | Razntch | |
| 1,088,328 | A | * | 2/1914 | Cucinotta | |
| 1,107,894 | A | | 8/1914 | Cain | |
| 1,113,266 | A | | 10/1914 | Wächter | |
| 1,147,508 | A | | 7/1915 | Hussey | |
| 1,154,340 | A | | 9/1915 | Rolfe | |
| 1,160,810 | A | | 11/1915 | Abramowitz | |
| 1,182,787 | A | | 5/1916 | Murphy | |
| 1,196,410 | A | | 8/1916 | Walker | |
| 1,352,865 | A | | 9/1920 | Augestad | 36/27 |
| 1,370,212 | A | | 3/1921 | Iaculli | |
| 1,380,879 | A | | 6/1921 | Young | |
| 1,403,970 | A | | 1/1922 | Lioy | |
| 1,502,087 | A | | 7/1924 | Bunns | |
| 1,522,890 | A | | 1/1925 | Krap | |
| 1,539,762 | A | | 5/1925 | Mussabini | |
| 1,587,749 | A | | 6/1926 | Bierly | |
| 1,726,028 | A | | 3/1929 | Keller | 36/7.8 |
| 1,894,681 | A | | 1/1933 | Greider | |
| 1,920,112 | A | | 7/1933 | Shaft | |
| D95,767 | S | | 5/1935 | Marks | |
| 2,002,706 | A | | 5/1935 | Mong | |
| 2,048,683 | A | | 7/1936 | Brockman | |
| 2,112,052 | A | | 3/1938 | Smith | 36/2.5 |
| D111,852 | S | | 10/1938 | Hurzeler | |
| 2,172,000 | A | | 3/1939 | Wenker | 272/70 |
| 2,178,025 | A | | 10/1939 | Richter | 36/2.5 |
| 2,183,277 | A | | 12/1939 | Heilhecker | 36/14 |
| 2,200,080 | A | | 5/1940 | Fein | 36/2.5 |
| D121,466 | S | | 6/1940 | Calderazzo | |
| 2,205,091 | A | | 6/1940 | Geffner | 36/2.5 |
| D122,607 | S | | 9/1940 | Nutt | |
| 2,220,534 | A | | 11/1940 | McLean | 36/11.5 |
| 2,236,367 | A | | 3/1941 | Gruber | 36/2.5 |
| 2,302,596 | A | | 11/1942 | Bigio | 36/2.5 |
| D145,816 | S | | 10/1946 | Payne | D7/7 |
| 2,413,545 | A | | 12/1946 | Cordi | 36/7.8 X |
| 2,414,445 | A | | 1/1947 | Cahill | 36/8.5 |
| 2,430,338 | A | | 11/1947 | Heiman | 36/12 |
| 2,435,668 | A | | 2/1948 | Bemringer et al. | 36/11.5 |
| 2,444,865 | A | * | 7/1948 | Warrington | |
| 2,447,603 | A | * | 8/1948 | Snyder | |
| 2,469,708 | A | | 5/1949 | Alexander | 36/11.5 |
| 2,491,930 | A | | 12/1949 | Parlante | 36/2.5 |
| 2,493,154 | A | | 1/1950 | Mavrakis | 36/2.5 |
| 2,497,175 | A | | 2/1950 | Mantos | 36/2.56 |
| 2,508,318 | A | * | 5/1950 | Wallach | |
| 2,537,156 | A | | 1/1951 | Pennell | 36/43 |
| 2,552,943 | A | | 5/1951 | Danielius | 36/15 |
| 2,579,953 | A | | 12/1951 | Morris | 36/7.6 |
| 2,588,061 | A | | 3/1952 | Vesely | 36/11.5 |
| 2,640,283 | A | | 6/1953 | McCord | 36/25 |
| 2,721,400 | A | | 10/1955 | Israel | 36/8.5 |
| 2,761,224 | A | | 9/1956 | Gardiner | 36/11.5 |
| 2,809,449 | A | | 10/1957 | Smith | 36/2.5 |
| 2,814,132 | A | | 11/1957 | Montoscuro | 36/37 |
| 2,873,540 | A | | 2/1959 | Murphy | 36/2.5 |
| 2,953,861 | A | | 9/1960 | Horten | 36/7.8 |
| 3,012,340 | A | | 12/1961 | Reinhart | 36/2.5 |
| 3,012,341 | A | | 12/1961 | Schaefer | 36/2.5 |
| D194,309 | S | | 1/1963 | Levine | D7/7 |
| D194,345 | S | | 1/1963 | Levine | D7/7 |
| 3,075,212 | A | | 1/1963 | Sherbrook | 12/142 |
| 3,142,910 | A | | 8/1964 | Levine | 36/2.5 |
| 3,204,346 | A | | 9/1965 | Lockard et al. | 36/2.5 |
| 3,214,849 | A | | 11/1965 | Nadaud | 36/38 |
| 3,251,144 | A | | 5/1966 | Weitzner | 36/2.5 |
| D205,882 | S | | 10/1966 | Post | D7/7 |
| 3,352,034 | A | | 11/1967 | Braun | 36/67 |
| 3,369,309 | A | | 2/1968 | Brooks | 36/2.5 |
| 3,404,468 | A | | 10/1968 | Rosen | 36/11 |
| 3,436,843 | A | | 4/1969 | Sacks | 36/2.5 |
| 3,541,708 | A | | 11/1970 | Rosen | 36/2.5 |
| 3,577,663 | A | | 5/1971 | Mershon | 36/67 |
| 3,597,863 | A | | 8/1971 | Austin | 36/59 |
| 3,686,777 | A | | 8/1972 | Rosen | 36/2.5 |
| 3,686,779 | A | | 8/1972 | Sacks | 36/2.5 W |
| 3,777,374 | A | | 12/1973 | Hendricks | 36/38 |
| 3,786,579 | A | | 1/1974 | Clark et al. | 36/7.6 |
| 3,818,617 | A | | 6/1974 | Dassler et al. | 36/32 R |
| 3,822,490 | A | | 7/1974 | Murawski | 36/2.5 R |
| 3,858,337 | A | | 1/1975 | Vogel | 36/55 |
| 3,878,626 | A | | 4/1975 | Isman | 36/15 |
| 3,886,674 | A | | 6/1975 | Pavia | 36/38 |
| 3,906,646 | A | | 9/1975 | Milotic | 36/2.5 C |
| 3,982,336 | A | | 9/1976 | Herro | 36/62 |
| 3,983,642 | A | | 10/1976 | Liao | 36/101 |
| 4,062,132 | A | | 12/1977 | Klimaszewski | 36/100 |
| 4,091,472 | A | | 5/1978 | Daher et al. | 623/55 |
| 4,103,440 | A | | 8/1978 | Lawrence | 36/101 |
| 4,107,857 | A | | 8/1978 | Devlin | 36/129 |
| 4,128,950 | A | | 12/1978 | Bowerman et al. | 36/30 R |
| 4,132,016 | A | | 1/1979 | Vaccari | 36/114 |
| 4,146,981 | A | | 4/1979 | Renaldo | 36/100 |
| 4,183,156 | A | | 1/1980 | Rudy | 36/44 |
| 4,187,623 | A | | 2/1980 | Dassler | 36/129 |
| 4,198,037 | A | | 4/1980 | Anderson | 267/153 |
| 4,217,705 | A | | 8/1980 | Donzis | 36/29 |
| 4,219,945 | A | | 9/1980 | Rudy | 36/29 |
| 4,237,625 | A | | 12/1980 | Cole et al. | 36/28 |
| 4,255,877 | A | | 3/1981 | Bowerman | 36/129 |
| 4,259,792 | A | | 4/1981 | Halberstadt | 36/28 |
| 4,262,434 | A | | 4/1981 | Michelotti | 36/67 |
| 4,267,649 | A | | 5/1981 | Smith | 36/101 |
| 4,267,650 | A | | 5/1981 | Bauer | 36/101 |
| 4,271,606 | A | | 6/1981 | Rudy | 36/29 |
| 4,271,607 | A | | 6/1981 | Funck | 36/30 |
| 4,279,083 | A | | 7/1981 | Dilg | 36/101 |
| 4,287,250 | A | | 9/1981 | Rudy | 428/166 |
| 4,300,294 | A | | 11/1981 | Riecken | 36/97 |
| 4,314,413 | A | | 2/1982 | Dassler | 36/129 |
| 4,317,294 | A | | 3/1982 | Goodyear | 36/100 |
| 4,322,893 | A | | 4/1982 | Halvorsen | 36/43 |
| 4,322,895 | A | | 4/1982 | Hockerson | 36/129 |
| 4,333,248 | A | | 6/1982 | Samuels | 36/72 R |
| 4,335,530 | A | | 6/1982 | Stubblefield | 36/83 |
| 4,340,626 | A | | 7/1982 | Rudy | 428/35 |
| 4,342,158 | A | | 8/1982 | McMahon et al. | 36/35 R |
| 4,343,057 | A | | 8/1982 | Bensley | 12/142 D |
| 4,351,120 | A | | 9/1982 | Dalebout | 36/117 |
| 4,358,902 | A | | 11/1982 | Cole et al. | 36/28 |
| 4,360,978 | A | | 11/1982 | Simpkins | 36/7.8 X |
| 4,364,188 | A | | 12/1982 | Turner et al. | 36/31 |
| 4,364,189 | A | | 12/1982 | Bates | 36/31 |
| 4,370,754 | A | | 2/1983 | Donzis | 2/2 |
| 4,372,058 | A | | 2/1983 | Stubblefield | 36/32 R |
| 4,377,042 | A | | 3/1983 | Bauer | 36/101 |
| 4,389,798 | A | | 6/1983 | Tilles | 36/129 |
| 4,391,048 | A | | 7/1983 | Lutz | 36/28 |
| 4,399,620 | A | | 8/1983 | Funck | 36/30 R |
| 4,402,146 | A | | 9/1983 | Parracho et al. | 36/129 |
| 4,429,474 | A | | 2/1984 | Metro | 36/36 A |
| 4,429,475 | A | | 2/1984 | Bensley | 36/45 |

4,430,810 A 2/1984 Bente ..... 36/32 R
4,439,935 A 4/1984 Kelly ..... 36/101
4,439,936 A 4/1984 Clarke et al. ..... 36/102
4,441,211 A 4/1984 Donzis ..... 2/2
4,450,633 A 5/1984 Connelly ..... 36/101
4,453,271 A 6/1984 Donzis ..... 2/2
4,471,538 A 9/1984 Pomeranz et al. ..... 36/28
4,481,726 A 11/1984 Phillips ..... 36/30 A
4,481,727 A 11/1984 Stubblefield ..... 36/83
4,484,397 A 11/1984 Curley, Jr. ..... 36/92
4,486,901 A 12/1984 Donzis ..... 2/2
4,486,964 A 12/1984 Rudy ..... 36/28
4,492,046 A * 1/1985 Kosova
4,497,123 A 2/1985 Ehrlich ..... 36/32 R
4,506,460 A 3/1985 Rudy ..... 36/28
4,506,462 A 3/1985 Cavanagh ..... 36/92
4,513,449 A 4/1985 Donzis ..... 2/2
4,523,396 A 6/1985 Dassler ..... 36/134
4,534,124 A 8/1985 Schnell ..... 36/114
4,535,554 A 8/1985 De Obaldia ..... 36/113
4,536,974 A 8/1985 Cohen ..... 36/28
D280,567 S 9/1985 Ji ..... D2/310
4,542,598 A 9/1985 Misevich et al. ..... 36/114
4,542,599 A 9/1985 Annovi ..... 36/117
4,561,195 A 12/1985 Onoda et al. ..... 36/30 R
4,562,651 A 1/1986 Frederick et al. ..... 36/102
4,566,206 A 1/1986 Weber ..... 36/27 X
4,577,417 A 3/1986 Cole ..... 36/29
4,578,882 A 4/1986 Talarico, II ..... 36/103
4,586,209 A 5/1986 Bensley ..... 12/142 D
4,592,153 A 6/1986 Jacinto ..... 36/38
4,598,487 A 7/1986 Misevich ..... 36/114
4,606,139 A 8/1986 Silver ..... 36/15
4,610,100 A 9/1986 Rhodes ..... 36/42
4,611,412 A 9/1986 Cohen ..... 36/28
4,620,372 A 11/1986 Talarico, II ..... 36/103
4,622,764 A 11/1986 Boulier ..... 36/68
4,638,576 A 1/1987 Parracho et al. ..... 36/68
4,642,911 A 2/1987 Talarico, II ..... 36/30 R
4,651,445 A 3/1987 Hannibal ..... 36/103
4,652,266 A 3/1987 Truesdell et al.
4,670,995 A 6/1987 Huang ..... 36/29
4,694,591 A 9/1987 Banich et al. ..... 36/102
4,706,392 A 11/1987 Yang ..... 36/101
4,727,611 A 3/1988 Kuhn ..... 36/100
4,741,114 A 5/1988 Stubblefield ..... 36/32 R
4,745,693 A 5/1988 Brown ..... 36/101
4,756,095 A 7/1988 Lakic ..... 36/2.6
4,766,679 A 8/1988 Bender ..... 36/30 R
4,768,295 A 9/1988 Ito ..... 36/28
4,771,554 A 9/1988 Hannemann ..... 36/27
4,783,910 A 11/1988 Boys, II et al. ..... 36/107
4,794,707 A 1/1989 Franklin et al. ..... 36/107
4,805,321 A 2/1989 Tonkel ..... 36/54
4,807,372 A 2/1989 McCall ..... 36/135
4,815,221 A 3/1989 Diaz ..... 36/27
4,817,304 A 4/1989 Parker et al. ..... 36/114
4,821,430 A 4/1989 Flemming et al. ..... 36/69
4,822,363 A 4/1989 Phillips et al.
4,833,795 A 5/1989 Diaz ..... 36/29
4,837,949 A 6/1989 Dutour ..... 36/127
4,843,737 A 7/1989 Vorderer ..... 36/38
4,854,057 A 8/1989 Misevich et al. ..... 36/114
4,858,341 A 8/1989 Rosen ..... 36/97
RE33,066 E 9/1989 Stubblefield ..... 36/83
4,874,640 A 10/1989 Donzis ..... 427/421
4,878,300 A 11/1989 Bogaty ..... 36/35 R
4,878,301 A 11/1989 Kiyosawa ..... 36/69
4,881,329 A 11/1989 Crowley ..... 36/38
4,887,367 A 12/1989 Mackness et al. ..... 36/28
4,887,369 A 12/1989 Bailey et al. ..... 36/101
4,890,397 A 1/1990 Harada et al. ..... 36/30 R
4,892,554 A 1/1990 Robinson et al.
4,894,934 A 1/1990 Illustrato ..... 36/37
4,897,938 A 2/1990 Otsuka ..... 36/88
4,906,502 A 3/1990 Rudy ..... 428/69
4,910,855 A 3/1990 Hsieh ..... 36/38 X
4,910,884 A 3/1990 Lindh et al. ..... 36/28
4,912,861 A 4/1990 Huang ..... 36/29
4,918,838 A 4/1990 Chang ..... 36/28
D307,608 S 5/1990 Shure ..... D21/72
4,922,631 A 5/1990 Anderié ..... 36/102
4,926,503 A 5/1990 Wingo, Jr. ..... 2/267
4,934,072 A 6/1990 Fredericksen et al. ..... 36/29
4,936,028 A 6/1990 Posacki ..... 36/15
4,936,029 A 6/1990 Rudy ..... 36/29
4,941,273 A 7/1990 Gross et al.
4,942,677 A 7/1990 Flemming et al. ..... 36/27
4,949,476 A 8/1990 Anderié ..... 36/129
4,958,447 A 9/1990 DuPree ..... 36/101
4,967,492 A 11/1990 Rosen ..... 36/97
4,970,807 A 11/1990 Anderié et al. ..... 36/28
4,974,344 A 12/1990 Ching ..... 36/101
4,985,931 A 1/1991 Wingo, Jr. ..... 2/2
4,989,349 A 2/1991 Ellis, III ..... 36/25 R
5,003,709 A 4/1991 Okayasu et al. ..... 36/107
5,005,300 A 4/1991 Diaz et al. ..... 36/114
5,014,449 A 5/1991 Richard et al. ..... 36/114
5,024,007 A 6/1991 Dutour ..... 36/127
5,029,341 A 7/1991 Wingo, Jr. ..... 2/2
5,035,009 A 7/1991 Wingo, Jr. et al. ..... 2/414
5,042,174 A 8/1991 Nichols ..... 36/25
5,042,176 A 8/1991 Rudy ..... 36/29
5,046,267 A 9/1991 Kilgore ..... 36/114
5,052,130 A 10/1991 Barry et al. ..... 36/107
5,060,401 A 10/1991 Whatley ..... 36/25 R
5,065,531 A 11/1991 Prestridge ..... 36/100
5,083,361 A 1/1992 Rudy ..... 29/454
5,083,385 A 1/1992 Halford ..... 36/101
5,092,060 A 3/1992 Frachey et al. ..... 36/29
5,097,607 A 3/1992 Fredericksen ..... 36/291
5,109,614 A 5/1992 Curry ..... 36/100
5,113,599 A 5/1992 Cohen et al. ..... 36/88
5,123,180 A 6/1992 Nannig et al. ..... 36/43
5,123,181 A 6/1992 Rosen ..... 36/97
5,131,173 A 7/1992 Anderié ..... 36/25 R
5,133,138 A 7/1992 Durcho ..... 36/36 R
5,138,776 A * 8/1992 Levin
5,155,927 A 10/1992 Bates et al. ..... 36/28
5,159,767 A * 11/1992 Allen
5,185,943 A 2/1993 Tong et al. ..... 36/28
D334,276 S 3/1993 Feller et al. ..... 82/314
5,191,727 A 3/1993 Barry et al. ..... 36/107
5,195,258 A 3/1993 Loader ..... 36/38
5,197,206 A 3/1993 Shorten ..... 36/29
5,197,207 A 3/1993 Shorten ..... 36/29
5,197,210 A 3/1993 Sink ..... 36/127
5,201,125 A 4/1993 Shorten ..... 36/29
5,203,095 A * 4/1993 Allen
5,212,878 A 5/1993 Burke et al. ..... 36/27
5,235,715 A 8/1993 Donzis ..... 12/142 R
5,247,742 A 9/1993 Kilgore ..... 36/114
D340,349 S 10/1993 Kilgore et al. ..... D2/318
D340,350 S 10/1993 Kilgore et al. ..... D2/318
5,255,451 A 10/1993 Tong et al. ..... 36/28
5,279,051 A 1/1994 Whatley ..... 36/25 R
5,280,680 A 1/1994 Burke et al. ..... 36/28
5,280,890 A 1/1994 Wydra ..... 267/220
D344,174 S 2/1994 Kilgore ..... D2/964
D344,398 S 2/1994 Kilgore ..... D2/967
D344,399 S 2/1994 Kilgore ..... D2/965
D344,400 S 2/1994 Kilgore ..... D2/965

| | | | | | |
|---|---|---|---|---|---|
| D344,401 | S | | 2/1994 | Kilgore | D2/965 |
| 5,282,325 | A | | 2/1994 | Beyl | 36/27 |
| 5,285,583 | A | | 2/1994 | Aleven | 36/44 |
| D344,622 | S | | 3/1994 | Kilgore | D2/964 |
| 5,297,349 | A | | 3/1994 | Kilgore | 36/114 |
| 5,313,717 | A | | 5/1994 | Allen et al. | 36/28 |
| 5,317,819 | A | | 6/1994 | Ellis, III | 36/25 R |
| 5,317,822 | A | | 6/1994 | Johnson | 36/101 |
| 5,319,866 | A | | 6/1994 | Foley et al. | 36/91 |
| D350,018 | S | | 8/1994 | Kilgore | D2/964 |
| D350,019 | S | | 8/1994 | Kilgore | D2/965 |
| D350,020 | S | | 8/1994 | Kilgore | D2/965 |
| 5,337,492 | A | | 8/1994 | Anderié et al. | 36/28 |
| 5,339,544 | A | | 8/1994 | Caberlotto | 36/102 |
| D350,225 | S | | 9/1994 | Kilgore | D2/964 |
| D350,226 | S | | 9/1994 | Kilgore | D2/964 |
| D350,227 | S | | 9/1994 | Kilgore | D2/964 |
| D350,433 | S | | 9/1994 | Kilgore | D2/961 |
| 5,343,636 | A | | 9/1994 | Sabol | 36/78 |
| 5,343,639 | A | | 9/1994 | Kilgore et al. | 36/29 |
| D351,057 | S | | 10/1994 | Kilgore | D2/964 |
| D351,720 | S | | 10/1994 | Kilgore | D2/967 |
| 5,353,522 | A | | 10/1994 | Wagner | 36/15 |
| 5,353,523 | A | | 10/1994 | Kilgore et al. | 36/29 |
| D351,936 | S | | 11/1994 | Kilgore | D2/965 |
| D352,159 | S | | 11/1994 | Kilgore | D2/965 |
| D352,160 | S | | 11/1994 | Kilgore | D2/967 |
| 5,363,570 | A | | 11/1994 | Allen et al. | 36/28 |
| 5,367,790 | A | * | 11/1994 | Gamow et al. | |
| 5,367,792 | A | | 11/1994 | Richard et al. | 36/114 |
| 5,369,896 | A | | 12/1994 | Frachey et al. | 36/29 |
| D354,617 | S | | 1/1995 | Kilgore | D2/964 |
| 5,381,608 | A | | 1/1995 | Claveria | 36/35 R |
| 5,384,973 | A | | 1/1995 | Lyden | 36/25 R |
| D355,755 | S | | 2/1995 | Kilgore | D2/964 |
| 5,390,430 | A | | 2/1995 | Fitchmun et al. | 36/30 |
| 5,401,564 | A | | 3/1995 | Lee et al. | 428/228 |
| 5,406,719 | A | | 4/1995 | Potter | 36/28 |
| 5,410,821 | A | | 5/1995 | Hilgendorf | 36/100 |
| 5,419,060 | A | | 5/1995 | Choi | 36/36 R |
| 5,425,184 | A | | 6/1995 | Lyden et al. | 36/29 |
| 5,435,079 | A | * | 7/1995 | Gallegos | |
| 5,437,110 | A | | 8/1995 | Goldston et al. | 36/38 |
| 5,461,800 | A | | 10/1995 | Luthi et al. | 36/28 |
| 5,483,757 | A | | 1/1996 | Frykberg | 36/101 |
| 5,493,792 | A | | 2/1996 | Bates et al. | 36/28 |
| 5,501,022 | A | | 3/1996 | Cohn | 36/2 R |
| 5,528,842 | A | | 6/1996 | Ricci et al. | 36/27 |
| 5,533,280 | A | | 7/1996 | Halliday | 36/101 |
| 5,542,198 | A | | 8/1996 | Famolare | 36/130 |
| 5,543,194 | A | | 8/1996 | Rudy | 428/69 |
| 5,544,429 | A | | 8/1996 | Ellis, III | 36/25 R |
| 5,544,430 | A | | 8/1996 | Jacko | 36/7.1 R |
| 5,560,126 | A | | 10/1996 | Meschan et al. | 36/42 |
| 5,566,477 | A | | 10/1996 | Mathis et al. | 36/100 |
| 5,570,523 | A | | 11/1996 | Lin | 36/112 |
| 5,572,804 | A | | 11/1996 | Skaja et al. | 36/29 |
| 5,595,004 | A | | 1/1997 | Lyden et al. | 36/29 |
| 5,596,819 | A | | 1/1997 | Goldston et al. | 36/35 R |
| 5,598,645 | A | | 2/1997 | Kaiser | 36/29 |
| 5,611,152 | A | | 3/1997 | Richard et al. | 36/28 |
| 5,615,497 | A | | 4/1997 | Meschan | 36/36 R |
| 5,625,964 | A | | 5/1997 | Lyden et al. | 36/29 |
| 5,628,129 | A | | 5/1997 | Kilgore et al. | 36/134 |
| 5,632,057 | A | | 5/1997 | Lyden | 12/146 B |
| 5,642,575 | A | | 7/1997 | Norton et al. | 36/27 |
| 5,644,857 | A | | 7/1997 | Ouellett et al. | 36/15 |
| 5,653,046 | A | | 8/1997 | Lawlor | 36/28 |
| 5,657,558 | A | | 8/1997 | Pohu | 36/131 |
| 5,659,979 | A | | 8/1997 | Sileo | 36/54 |
| 5,661,915 | A | | 9/1997 | Smith | 36/15 |
| 5,678,327 | A | | 10/1997 | Halberstadt | 36/27 |
| 5,678,329 | A | | 10/1997 | Griffin et al. | 36/50.1 |
| 5,701,686 | A | * | 12/1997 | Herr et al. | |
| 5,704,137 | A | | 1/1998 | Dean et al. | 36/28 |
| 5,709,954 | A | | 1/1998 | Lyden et al. | 428/500 |
| 5,718,063 | A | | 2/1998 | Yamashita et al. | 36/28 |
| 5,729,912 | A | | 3/1998 | Gutkowski et al. | 36/97 |
| 5,743,028 | A | | 4/1998 | Lombardino | 36/27 |
| 5,755,001 | A | | 5/1998 | Potter | 12/142 P |
| 5,775,005 | A | | 7/1998 | McClelland | 36/31 |
| 5,778,564 | A | | 7/1998 | Kettner | 36/101 |
| 5,778,565 | A | | 7/1998 | Holt et al. | 36/110 |
| 5,784,808 | A | | 7/1998 | Hockerson | 36/102 |
| 5,786,057 | A | | 7/1998 | Lynden et al. | 428/52 |
| 5,787,610 | A | | 8/1998 | Brooks | 36/28 |
| 5,802,739 | A | | 9/1998 | Potter | 36/29 |
| 5,806,209 | A | | 9/1998 | Crowley et al. | 36/28 |
| 5,806,210 | A | | 9/1998 | Meschan | 36/36 R |
| 5,813,146 | A | | 9/1998 | Gutkowski et al. | 36/97 |
| 5,822,886 | A | | 10/1998 | Luthi et al. | 36/28 |
| 5,826,352 | A | | 10/1998 | Meschan et al. | 36/42 |
| 5,832,630 | A | | 11/1998 | Potter | 36/29 |
| 5,832,634 | A | | 11/1998 | Wong | 36/107 |
| 5,836,094 | A | | 11/1998 | Figel | 36/131 |
| 5,843,268 | A | | 12/1998 | Lyden et al. | 156/324.4 |
| 5,848,484 | A | | 12/1998 | DuPree et al. | 36/101 |
| 5,852,887 | A | | 12/1998 | Healy et al. | 36/88 |
| 5,853,844 | A | | 12/1998 | Wen | 428/119 |
| 5,875,567 | A | | 3/1999 | Bayley | 36/27 |
| 5,896,608 | A | | 4/1999 | Whatley | 12/142 T |
| 5,906,872 | A | | 5/1999 | Lyden et al. | 428/52 |
| 5,915,820 | A | | 6/1999 | Kraeuter et al. | 36/114 |
| 5,918,384 | A | | 7/1999 | Meshan | 36/37 |
| 5,921,004 | A | | 7/1999 | Lyden | 36/35 R |
| 5,930,918 | A | | 8/1999 | Healy et al. | 36/29 |
| 5,937,544 | A | | 8/1999 | Russell | 36/28 |
| 5,970,628 | A | | 10/1999 | Meshan | 36/42 |
| 5,987,779 | A | | 11/1999 | Litchfield e tal. | 36/29 |
| 5,987,780 | A | | 11/1999 | Lyden et al. | 36/29 |
| 5,993,585 | A | | 11/1999 | Goodwin | 156/145 |
| 5,996,255 | A | | 12/1999 | Ventura | 36/44 |
| 6,009,636 | A | | 1/2000 | Wallerstein | 36/7.8 |
| 6,009,641 | A | | 1/2000 | Ryan | 36/131 |
| 6,013,340 | A | | 1/2000 | Bonk et al. | 428/35.2 |
| 6,029,374 | A | * | 2/2000 | Herr et al. | |
| 6,041,521 | A | | 3/2000 | Wong | 36/28 |
| 6,050,002 | A | | 4/2000 | Meshan | 36/37 |
| 6,055,746 | A | | 5/2000 | Lyden et al. | 36/29 |
| 6,055,747 | A | | 5/2000 | Lombardino | 36/27 |
| 6,079,125 | A | | 6/2000 | Quellais et al. | 36/25 |
| 6,082,025 | A | | 7/2000 | Bonk et al. | 36/29 |
| D429,877 | S | | 8/2000 | Lozano et al. | D2/972 |
| 6,098,313 | A | | 8/2000 | Skaja | 36/28 |
| 6,098,316 | A | | 8/2000 | Hong | 36/97 |
| 6,115,941 | A | | 9/2000 | Ellis, III | 36/25 R |
| 6,155,942 | A | | 9/2000 | Paradis | 36/27 |
| D731,898 | | | 10/2000 | Clegg et al. | D2/972 |
| 6,131,309 | A | | 10/2000 | Walsh | 36/28 |
| D433,213 | S | | 11/2000 | Schuette et al. | D2/957 |
| D433,216 | S | | 11/2000 | Avar et al. | D2/972 |
| 6,178,664 | B1 | | 1/2001 | Yant et al. | 36/44 |

FOREIGN PATENT DOCUMENTS

| | | | |
|---|---|---|---|
| DE | 3034126 A1 | 3/1982 | |
| DE | 3219652 A1 | 12/1983 | A43C/15/16 |
| DE | 3415705 | 10/1985 | 36/28 |
| DE | 3415705 A1 | 10/1985 | |
| DE | 29 29 365 A1 | 2/1989 | A43B/13/26 |
| DE | 4120133 A1 | 12/1992 | B29C/45/14 |
| DE | 4120134 A1 | 12/1992 | B32B/7/04 |
| DE | 4120136 A1 | 12/1992 | A43B/13/26 |

| | | | | |
|---|---|---|---|---|
| DE | 4123302 | A1 | 1/1993 | ..... A43C/15/16 |
| DE | 4210292 | A1 | 9/1993 | ..... A43B/13/26 |
| DE | 4214802 | A1 | 11/1993 | ..... A43B/13/02 |
| DE | 4214802 | | 11/1993 | ..... A43B/13/02 |
| DE | 1808245 | | 2/1996 | |
| EP | 0103041 | | 3/1984 | ..... 36/27 |
| EP | 0 272 082 | A2 | 6/1988 | ..... A43B/13/18 |
| EP | 0443293 | A1 | 8/1991 | ..... A43B/3/26 |
| EP | 0 471 447 | B1 | 2/1992 | ..... A43B/13/00 |
| EP | 0 619 084 | A1 | 10/1994 | ..... A43B/13/18 |
| EP | 0 752 216 | A2 | 1/1997 | ..... A43B/7/14 |
| EP | 0 890 321 | A2 | 1/1999 | ..... A43B/5/00 |
| EP | 0 947 145 | A1 | 10/1999 | ..... A43B/13/18 |
| EP | 1025770 | A2 | 2/2000 | ..... A43B/13/12 |
| EP | 1048233 | A2 | 2/2000 | ..... A43B/13/12 |
| EP | 1 016 353 | A2 | 7/2000 | ..... A43B/5/00 |
| EP | 1033087 | A1 | 9/2000 | ..... A43B/7/24 |
| FR | 141998 | | of 1903 | |
| FR | 424140 | | 5/1911 | |
| FR | 0472735 | | 12/1916 | ..... 36/37 |
| FR | 701729 | | 3/1931 | |
| FR | 1227420 | | 8/1960 | ..... 36/37 |
| FR | 2448308 | | 2/1980 | ..... A43B/13/14 |
| FR | 2507066 | | 12/1982 | ..... 36/27 |
| FR | 2658396 | | 8/1991 | |
| GB | 443571 | | 2/1936 | |
| GB | 608180 | | 9/1948 | |
| GB | 2189978 | A | 11/1987 | ..... A43B/13/18 |
| GB | 2200030 | | 7/1988 | ..... 36/27 |
| GB | 2200030 | A * | 7/1988 | |
| GB | 2256784 | A | 12/1992 | ..... A43B/13/00 |
| IT | 633409 | | 2/1962 | |
| JP | 4024001 | | 1/1992 | ..... A43B/13/12 |
| WO | 91/11698 | | 10/1990 | ..... A43B/3/26 |
| WO | 91/01659 | | 2/1991 | ..... A43B/13/14 |
| WO | 91/09547 | | 7/1991 | ..... A43B/13/18 |
| WO | 92/08384 | | 5/1992 | ..... A43B/13/18 |
| WO | 94/13164 | | 6/1994 | ..... A43B/13/00 |
| WO | 94/21454 | | 9/1994 | ..... B32B/15/00 |
| WO | 95/15570 | | 11/1995 | |
| WO | WO9807341 | | 2/1998 | |
| WO | 98/07343 | | 2/1998 | ..... A43B/13/18 |

* cited by examiner

ARTICLE OF FOOTWEAR HAVING A SPRING ELEMENT AND SELECTIVELY REMOVABLE COMPONENTS

FIELD OF THE INVENTION

The present invention relates to articles of footwear, and in particular, to those including spring elements, and to footwear constructions which include selectively removable and renewable components.

BACKGROUND OF THE INVENTION

The article of footwear taught in the present invention includes a spring element which can provide improved cushioning, stability, running economy, and a long service life. Unlike the conventional foam materials presently being used by the footwear industry, the spring element is not substantially subject to compression set degradation and can provide a relatively long service life. The components of the article of footwear including the upper, insole, spring element, and outsole portions can be selected from a range of options, and can be easily removed and replaced, as desired. Further, the relative configuration and functional relationship as between the forefoot, midfoot and rearfoot areas of the article of footwear can be readily modified and adjusted. Accordingly, the article of footwear can be customized by a wearer or specially configured for a select target population in order to optimize desired performance criteria.

Conventional athletic footwear typically include an outsole made of a rubber compound which is affixed by adhesive to a midsole made of ethylene vinyl acetate or polyurethane foam material which is in turn affixed by adhesive to an upper which is constructed with the use of stitching and adhesives. Because of the difficulty, time, and expense associated with renewing any portion of conventional articles of footwear, the vast majority are generally discarded at the end of their service life. This service life can be characterized as having a short duration when the wearer frequently engages in athletic activity such as distance running or tennis. In tennis, portions of the outsole can be substantially abraded within a few hours, and in distance running the foam midsole can become compacted and degrade by taking a compression set within one hundred miles of use. The resulting deformation of the foam midsole can degrade cushioning, footwear stability, and contribute to athletic injuries. Accordingly, many competitive distance runners who routinely cover one hundred miles in a week's time will discard their athletic footwear after logging three hundred miles in order to avoid possible injury.

Even though the service life of conventional athletic footwear is relatively short, the price of athletic footwear has steadily increased: over the last three decades, and some models now bear retail prices over one hundred and twenty dollars. However, some of this increase in retail prices has been design and fashion driven as opposed to reflecting actual value added, thus some individuals believe that the best values on functional athletic footwear can be found in the price range of fifty to eighty dollars. In any case, conventional athletic footwear remain disposable commodities and few are being recycled. The method of manufacture and disposal of conventional athletic footwear is therefore relatively inefficient and not environmentally friendly.

In contrast with conventional athletic footwear, the present invention teaches an article of footwear that includes spring elements which do not take a compression set or similarly degrade, thus the physical and mechanical properties afforded by a preferred article of footwear remain substantially the same over a useful service life which can be several times longer than that of conventional articles footwear. The present invention teaches an article of footwear which represents an investment, as opposed to a disposable commodity. Like an automobile, the preferred article of footwear includes components which can be easily renewed and replaced, but also components which can be varied and customized, as desired.

Prior art examples devices and means for selectively and removably affixing various components of an article of footwear include, e.g., U.S. Pat. No. 2,183,277, U.S. Pat. No. 2,200,080, U.S. Pat. No. 2,552,943, U.S. Pat. No. 2,640,283, U.S. Pat. No. 3,818,617, U.S. Pat. No. 3,878,626, U.S. Pat. No. 3,906,646, U.S. Pat. No. 3,982,336, U.S. Pat. No. 4,103,440, U.S. Pat. No. 4,262,434, U.S. Pat. No. 4,267,650, U.S. Pat. No. 4,279,083, U.S. Pat. No. 4,300,294, U.S. Pat. No. 4,317,294, U.S. Pat. No. 4,351,120, U.S. Pat. No. 4,377,042, U.S. Pat. No. 4,606,139, U.S. Pat. No. 4,807,372, U.S. Pat. No. 4,887,369, U.S. Pat. No. 5,083,385, U.S. Pat. No. 5,317,822, U.S. Pat. No. 5,410,821, U.S. Pat. No. 5,533,280, U.S. Pat. No. 5,542,198, U.S. Pat. No. 5,615,497, U.S. Pat. No. 5,644,857, U.S. Pat. No. 5,657,558, U.S. Pat. No. 5,661,915, and U.S. Pat. No. 5,826,352.

Conventional athletic footwear cannot be substantially customized for use by the consumer or wearer. The physical and mechanical properties of conventional athletic footwear are relatively fixed generic qualities. However, the body weight or mass and characteristic running technique of different individuals having the same footwear size can vary greatly. Often, the stiffness in compression of the foam material used in the midsole of athletic shoes can be too soft for individuals who employ more forceful movements, or who have greater body mass than, an average wearer. Accordingly, conventional articles of athletic footwear do not provide. optimal performance characteristics for individual wearers.

In contrast, the present invention permits a wearer to customize a preferred article of footwear. For example, the length, width, girth, and configuration of the upper, as provided by various last options, or by two or three dimensional modeling and footwear design equipment such as computer software, or by two, three, or four dimensional measurement devices such as scanners, as well as the type of footwear construction and design of the upper can be selected by the consumer or wearer. Further, the physical and mechanical properties of the article of footwear can be selected and changed as desired in order to optimize desired performance characteristics given various performance criteria or environmental conditions. For example, the configuration and geometry of the article of footwear, and the stiffness of the spring elements can be customized, as desired. In addition, the ability to easily remove, renew, and recycle the outsole portions of the preferred article of footwear renders the use of softer materials having enhanced shock and vibration dampening characteristics, but perhaps diminished wear properties viable from a practical standpoint. Moreover, the outsole portion of the preferred article of. footwear can be selected from a variety of options with regards to configuration, materials, and function.

The physical and mechanical properties associated with an article of footwear of the present invention can provide enhanced cushioning, stability, and running economy relative to conventional articles of footwear. The spring to dampening ratio of conventional articles of footwear is commonly in the range between 40–60 percent, whereas the preferred article of footwear can provide a higher spring to dampening ratio, thus greater mechanical efficiency and running economy. The preferred article of footwear can include an anterior spring element that underlies the forefoot area which can store energy during the latter portion of the stance phase and early portion of the propulsive phase of the running cycle, and then release this energy during the latter portion of the propulsive phase, thus facilitating improved running economy. It is believed that the resulting improvement in running performance can approximate one second over four hundred meters, or two to three percent.

The preferred article of footwear can provide differential stiffness in the rearfoot area so as to reduce both the rate and magnitude of pronation, or alternately, the rate and magnitude of supination experienced by an individual wearer, thus avoid conditions which can be associated with injury. Likewise, the preferred article of footwear can provide. differential stiffness in the midfoot and forefoot areas so as to reduce both the rate and magnitude of inward and/or outward rotation of the foot, thus avoid conditions which can be associated with injury. The preferred spring elements can also provide a stable platform which can prevent or reduce the amount of deformation caused by point loads, thus avoid conditions which can be associated with injury.

Again, the viability of using relatively soft outsole materials having improved shock and vibration dampening characteristics can enhance cushioning effects. Further, in conventional articles of footwear, the shock and vibration generated during rearfoot impact is commonly transmitted most rapidly to a wearer through that portion of the outsole and midsole which has greatest stiffness, and normally, this is a portion of the sole proximate the heel of the wearer which undergoes the greatest deflection and deformation. However, in the present invention a void space exists beneath the heel of a wearer and the ground engaging portion of the outsole. Some of the shock and vibration generated during the rearfoot impact of an outsole with the ground support surface must then travel a greater distance through the outsole and inferior. spring element in order to be transmitted to the superior spring element and a wearer. In addition, in the present invention, a posterior spacer which serves as a shock and vibration isolator, and also. vibration decay time modifiers can be used to decrease the magnitude of the shock and vibration transmitted to the wearer of a preferred article of footwear.

There have been many attempts in the prior art to introduce functional spring elements into articles of footwear including, but not limited to U.S. Pat. No. 357,062, U.S. Pat. No. 1,107,894, U.S. Pat. No. 1,113,266, U.S. Pat. No. 1,352,865, U.S. Pat. No. 1,370,212, U.S. Pat. No. 2,447,603, U.S. Pat. No. 2,508,318, U.S. Pat. No. 4,429,474, U.S. Pat. No. 4,492,046, U.S. Pat. No. 4,314,413, U.S. Pat. No. 4,486,964, U.S. Pat. No. 4,506,460, U.S. Pat. No. 4,566,206, U.S. Pat. No. 4,771,554, U.S. Pat. No. 4,854,057, U.S. Pat. No. 4,878,300, U.S. Pat. No. 4,942,677, U.S. Pat. No. 5,052,130, U.S. Pat. No. 5,060,401, U.S. Pat. No. 5,138,776, U.S. Pat. No. 5,159,767, U.S. Pat. No. 5,203,095, U.S. Pat. No. 5,279,051, U.S. Pat. No. 5,337,492, U.S. Pat. No. 5,343,639, U.S. Pat. No. 5,353,523, U.S. Pat. No. 5,367,790, U.S. Pat. No. 5,381,608, U.S. Pat. No. 5,437,110, U.S. Pat. No. 5,461,800, U.S. Pat. No. 5,596,819, U.S. Pat. No. 5,701,686, U.S. Pat. No. 5,822,886, U.S. Pat. No. 5,875,567, U.S. Pat. No. 5,937,544, and, 6,029,374, all of these patents hereby being incorporated by reference herein. Relatively few of these attempts have resulted in functional articles of footwear which have met with commercial success. The limitations of some of the prior art has concerned the difficulty of meeting the potentially competing criteria associated with cushioning and footwear stability. In other cases, the manufacturing costs of making prior art articles of footwear including spring elements have proved prohibitive.

The present invention teaches an article of footwear which can provide a wearer with improved cushioning and stability, running economy, and an extended service life while reducing the risks of injury normally associated with footwear degradation. The preferred article of footwear provides a wearer with the ability to customize the fit, but also the physical and mechanical properties and performance of the article of footwear. Moreover, the preferred article of footwear is economical and environmentally friendly to both manufacture and recycle.

SUMMARY OF THE INVENTION

A preferred article of footwear has an anterior side, posterior side, medial side, lateral side, longitudinal axis transverse axis and includes an upper, and a spring element including a superior spring element, and an inferior spring element. The inferior spring element is affixed in function relation to the superior spring element and projects rearward and downward therefrom, and has an flexural axis deviated from the transverse axis in the range between 10 and 50 degrees.

It can be advantageous for the flexural axis to be deviated from the transverse axis in the range between 10 and 30 degrees in articles of footwear intended for walking, or for use by runners who tend to supinate during the braking and stance phases of the running cycle, and in the range between 30 and 50 degrees for runners who tend to pronate during the braking and stance phases of the running cycle. Accordingly, posterior oft he flexural axis, the anterior to posterior lengths of the superior spring element and the inferior spring element can be shorter on the medial side than on the lateral side.

The preferred article of footwear includes a spring element having a superior spring element which can be formed in a shape substantially corresponding to the footwear last bottom, and an inferior spring element. The superior spring element can consist of a single component, or can consist of two portions, an anterior spring element and a posterior spring element which are affixed together in functional relation. In an alternate embodiment, the anterior spring element and inferior spring element can consist of a single component, or alternately, can be affixed together in functional relation, and the posterior spring element can be affixed in functional relation thereto. Further, it can be readily understood that an equivalent spring element can be formed as a single part, or in four parts.

The superior spring element can be positioned in functional relation within the upper and the outsole can be positioned inferior to the upper, and a plurality of fasteners can be used for affixing the superior spring element to the outsole, thus trapping and securing the upper in functional relation therebetween. Further, a plurality of fasteners can be used to selectively affix the superior spring element in functional relation to the upper and the inferior spring element. The upper can further include a sleeve for affixing at least a portion of the superior spring element in function relation thereto.

The superior spring element and inferior spring element can be configured or affixed in functional relation to form a v-shape in the rearfoot area of an article of footwear and provide deflection in the range between 8–15 mm, and preferrably approximately 10 mm.

At the posterior side, the v-shaped spring element can exhibit less stiffness in compression on the lateral side relative to the medial side, and it can be advantageous that the differential stiffness be in the range between two-to-three to one.

The superior spring element can have a thickness in the range between 1.0 and 3.5 mm. The superior spring element can include an anterior spring element having a thickness in the range between 1.0–2.0 mm, and a posterior spring element having a thickness in the range between 2.0 and 3.5 mm. The inferior spring element can have a thickness in the range between 2.0 and 3.5 mm.

The posterior spring element can further include a projection, and the anterior spring element and posterior spring element can be. affixed by at least three fasteners in triangulation.

The superior spring element can be generally planar, or alternately can be curved to mate with the anatomy of a wearer and further include elevated portions such as a side stabilizer or a heel counter.

The spring element can be made of a fiber composite material, or alternately, a thermoplastic material, or a metal material. The spring element can include areas having different thickness, notches, slits, or openings which serve to produce differential stiffness when the spring element is loaded. The spring element can include different types, orientations, configurations, and numbers of composite layers, and in different areas, in order to achieve differential stiffness when the spring element is loaded. Accordingly, the flexural modulus or stiffness exhibited by a spring element in the rearfoot, midfoot, and forefoot areas, and about any axis can be engineered, as desired.

The article of footwear can include a selectively removable outsole. The outsole can include an anterior outsole element and posterior outsole element. Alternately, the outsole can consist of a single component, or a three part component including an anterior outsole element, a middle outsole element and a posterior outsole element. The outsole can include a backing, a tread or ground engaging surface, and lines of flexion.

The article of footwear can further include a spring guard for protecting the posterior aspect of the mating portions of the superior spring element or posterior spring element and the inferior spring element.

The article of footwear can further include, an anterior spacer positioned between the anterior spring element and the posterior spring element for dampening shock and vibration. The anterior spacer can have a wedge shape which can be used to modify the configuration and performance of the article of footwear.

The article of footwear can further include a posterior spacer positioned between the superior spring element or posterior spring element and the inferior spring element for dampening shock and vibration. The posterior spacer can have a wedge shape which can be used to modify the configuration and performance of the article of footwear.

The article of footwear can further include a vibration decay time modifier. The vibration decay time modifiers can include a head and a stem. The head of the vibration decay time modifiers can be dimensioned and configured for vibration substantially free of contact with the base of the posterior spacer or spring element in directions which substantially encompass a 360 degree arc and normal to the longitudinal axis of the stem.

A preferred article of footwear can include an anterior side, posterior side, medial side, lateral side, and an upper affixed in functional relation to a spring element comprising an anterior spring element, a posterior spring element, and an inferior spring element. The anterior spring element can be affixed in functional relation to the posterior spring element, and a substantial portion of the anterior spring element can extend anterior of a position associated with 70 percent of the length of the upper as measured from the posterior side. The inferior spring element can be affixed in function relation to the posterior spring element, and a substantial portion of the inferior spring element can extend posterior of a position associated with 50 percent of the length of the upper as measured from the posterior side.

In an alternate embodiment of an article of footwear, the spring element can consist of a superior spring element which can include an anterior spring element and a posterior spring element affixed together in functional relation, but not include an inferior spring element projecting rearward and downward therefrom.

The ability to easily customize and adapt the preferred article of footwear in a desired manner can render the present invention suitable for use in walking, running, and a variety of other athletic activities including tennis, basketball, baseball, football, soccer, bicycling, and in-line skating.

DESCRIPTION OF THE DRAWING FIGURES

DETAILED DESCRIPTION OF THE PREFERRED EMBODIMENTS

The article of footwear taught in the present invention includes a spring element which can provide improved cushioning, stability, running economy, and a long service life. Unlike the conventional foam materials presently being used by the footwear industry, the spring element is not substantially subject to compression set degradation and can provide a relatively long service life. The components of the article of footwear including the upper, insole, spring element, and outsole portions can be selected from a range of options, and can be easily removed and replaced, as desired. Further, the relative configuration and functional relationship as between the forefoot, midfoot and rearfoot areas of the article of footwear can be readily modified and adjusted. Accordingly, the article of footwear can be customized by a wearer or specially configured for a select target population in order to optimize desired performance criteria.

Figure 1:
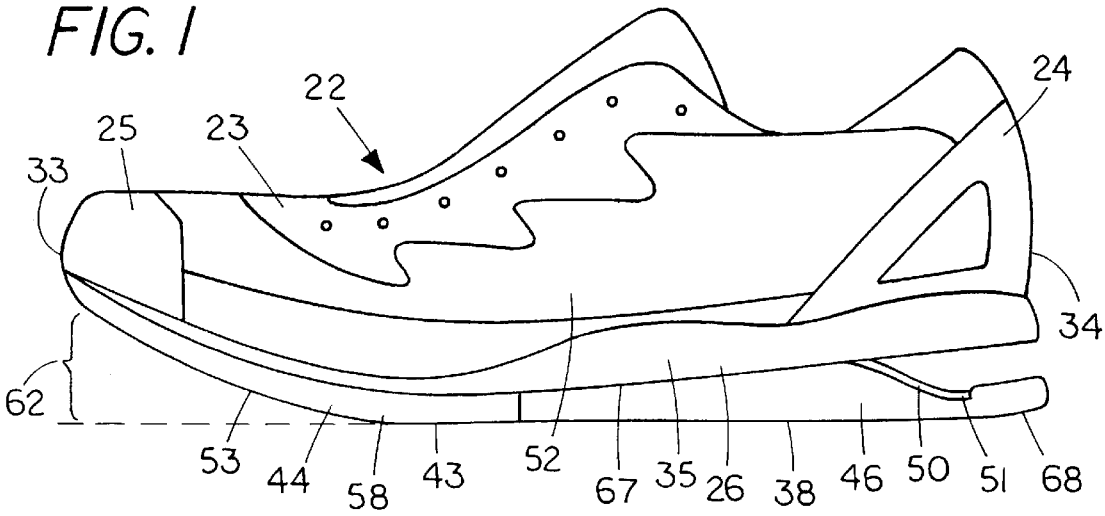
FIG. 1 is a medial side view of an article of footwear including a spring element according to the resent invention.
Figure 4:
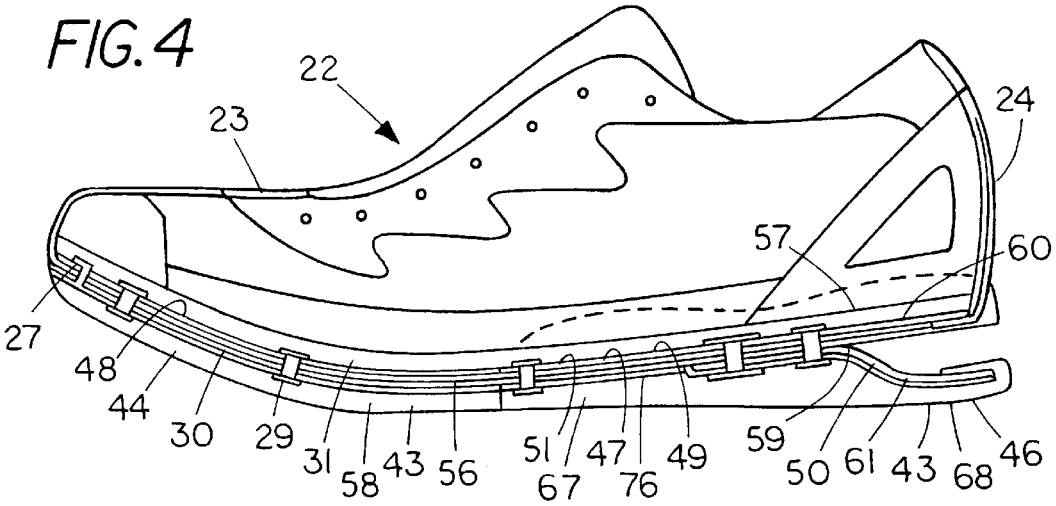
FIG. 4 is a medial side view of the article of footwear shown in FIG. 1, with parts broken away.

FIG. 1 is a medial side view of an article of footwear 22 including a spring element 51 consisting of at least two portions, a superior spring element 47 and an inferior spring element 50. The portions of spring element 51 can be integrally formed in a single component, but are preferably formed in at least two parts which can be affixed together by adhesives, or preferably by conventional means such as fasteners 29 having mating male and female parts, or other mechanically mating parts, and the like Preferably the fasteners 29 can he selectively removable, thus enable various portions of the spring element, 51 and article 22 of footwear 22 to be removed and replaced, as desired. The fasteners 29 can include Allen head or star drive mechanical mating configurations for use with a like tool, and the fasteners 29 can be torque limited to tighten to an appropriate and desired torque value. It can be readily understood that other conventional means can be used to affix the upper 23 in functional relation to the spring element 51 and outsole 43, such as VELCRO® hook and pile, or other mechanically mating surfaces or devices. For example, as shown in FIG. 4, a portion of the posterior outsole element 46 can slip over and trap a portion of the inferior spring element 50 and then be secured with fasteners 29. Further, at least one hook 27 can extend from the backing 30 of anterior outsole element 44 and engage a portion of the upper 23 or the superior spring element 47 as a portion of the outsole 43 is attached to a preferred article of footwear 22. Again, prior art examples of means for selectively and removably affixing various components of an article of footwear include, e.g., U.S. Pat. No. 2,183,277, U.S. Pat. No. 2,200,080, U.S. Pat. No. 2,552,943, U.S. Pat. No. 2,640,283, U.S. Pat. No. 3,818,617, U.S. Pat. No. 3,878,626, U.S. Pat. No. 3,906,646, U.S. Pat. No. 3,982,336, U.S. Pat. No. 4,103,440, U.S. Pat. No. 4,262,434, U.S. Pat. No. 4,267,650, U.S. Pat. No. 4,279,083, U.S. Pat. No. 4,300,294, U.S. Pat. No. 4,317,294, U.S. Pat. No. 4,351,120, U.S. Pat. No. 4,377,042, U.S. Pat. No. 4,606,139, U.S. Pat. No. 4,807,372, U.S. Pat. No. 4,887,369, U.S. Pat. No. 5,083,385, U.S. Pat. No. 5,317,822, U.S. Pat. No. 5,410,821, U.S. Pat. No. 5,533,280, U.S. Pat. No. 5,542,198, U.S. Pat. No. 5,615,497, U.S. Pat. No. 5,644,857, U.S. Pat. No. 5,657,558, U.S. 5,661,915, and U.S. Pat. No. 5,826,352, all of these patents hereby being incorporated by reference herein.

Also shown in FIG. 1 is an upper 23 including a heel counter 24, tip 25, vamp 52, anterior side 33, posterior side 34, medial side 315, top or superior side 37, bottom or inferior side 38, forefoot area 58, midfoot area 67, rearfoot area 68, midsole 26, a spring element 51 including an inferior spring element 50, an outsole 43 including an anterior outsole element 44 and posterior outsole element 46 having a tread or ground engaging surface 53, and the presence of toe spring 62. The upper 23 can be made of a plurality of conventional materials known in the footwear art such as leather, natural or synthetic textile materials, paper or cardboard, stitching, adhesive, thermoplastic material, foam material, and natural or synthetic rubber. Since the various components of a preferred article of footwear 22 can be easily removed and replaced, a wearer can select a custom upper 23 having a desired size, shape, design, construction and functional capability. The article of footwear 22 can also include means for customizing the shape, width, and fit of the upper such as taught in U.S. Pat. No. 5,729,912, U.S. Pat. No. 5,813,146, and the like. Further, the article of footwear 22 can include a custom insole, but also a custom upper using light cure material as taught in the applicant's U.S. Pat. No. 5,632,057, hereby incorporated by reference herein.

As shown in FIG. 4, the anterior outsole element 44 and posterior outsole element 46 can include a backing 30 portion. The ground engaging portion 53 of the outsole 43 can be made of a natural or synthetic rubber material such as nitrile or styrene butadiene rubber, a thermoplastic material, an elastomer such as polyurethane, or a hybrid thermoplastic rubber. Further, these materials can possibly be suitable for use when blown or foamed. Suitable hybrid thermoplastic and rubber combinations include dynamically vulcanized alloys which can be injection molded such as those produced by Advanced Elastomer Systems, 338 Main Street, Akron, Ohio 44311, e.g., SANTOPRENE®, VYRAM®, GEOLAST®, TREFSIN®, VISTAFLEX®, GEOLAST®, DYTROL XL®, and taught in the following U.S. Pat. Nos.; 5,783,631, 5,779,968, 5,777,033, 5,777,029, 5,750,625, 5,672,660, 5,609,962, 5,591,798, 5,589,544, 5,574,105, 5,523,350, 5,403,892, 5,397,839, 5,397,832, 5,349,005, 5,300,573, 5,290,886, 5,177,147, 5,157,081, 5,100,947, 5,086,121,5,081,179, 5,073,597, 5,070,111, 5,051,478, 5,051,477, 5,028,662, and RE 035398. SANTOPRENE® is known to consist of a combination of butyl rubber and ethylene-propylene. The backing 30 portion of the outsole 43 can be made of a formulation of a thermoplastic material such as nylon, polyurethane, or SANTOPRENE® that is relatively firm relative to the ground engaging portion 53 of the outsole 43. For example, a polyurethane or SANTOPRENE® material having a hardness between 35–75 Durometer Asker C could be used on the ground engaging portion 53 of the outsole 43, and a polyurethane or SANTOPRENE® material having a hardness between 75–100 Durometer on the Shore A or D Scales could be used to make the backing 30 of outsole 43. A polyurethane backing 30 can be bonded to a polyurethane ground engaging portion 53 of outsole 43, or alternately, a SANTOPRENE® backing can be bonded to a SANTOPRENT® ground engaging portion 53 of outsole 43. This can be accomplished by dual injection molding, or overmolding of the like materials. One advantage when using homogenous materials for the two portions of the outsole 43 concerns the affinity of like materials for effectively bonding together.

Another advantage in using homogenous materials for the two portions of the outsole 43 concerns the "green" or environmentally friendly and recyclable nature of the component at the end of its service life. It is possible for the spent homogenous outsole 43 component including the backing 30 and ground engaging portion 53 to be recycled by the footwear manufacturer or by a third party, e.g., the outsole 43 can be re-ground into pieces and be thermoformned to make a portion of a new outsole 43 component Further, the relative absence of adhesives in the manufacture of and article of footwear taught in the present invention also makes for a "green" or environmentally friendly product. In contrast, conventional articles of footwear are commonly manufactured with the extensive use of adhesives for bonding foam midsole to an upper and outsole. These adhesives are commonly non-environmentally friendly and can pose health hazards, and the resulting article of footwear cannot be so easily disassembled or recycled at the end of its service life. Moreover, the process associated with making conventional foam materials in making a midsole, and the blowing agents used therein, can be non-environmentally friendly and relatively energy inefficient as compared with conventional injection molding of thermoplastic materials, or the use of light cure materials and methods, as taught in the applicant's co-pending U.S. patent application Ser. No. 08/862,598 entitled "Method of Making a Light Cure Component For Articles of Footwear," hereby incorporated by reference herein. For example, instead of using large presses imparting both heat and pressure upon compression molds for effecting the cure of a midsole or outsole component over perhaps a seven minute cycle time, injection molding equipment and light cure technology can be used to reduce the cycle times to perhaps fractions of a second with relative energy efficiency and little or no waste product in a relatively environmentally friendly manufacturing environment. Accordingly, manufacturing can be located in the United States, or otherwise closer to the intended market.

Figure 16:
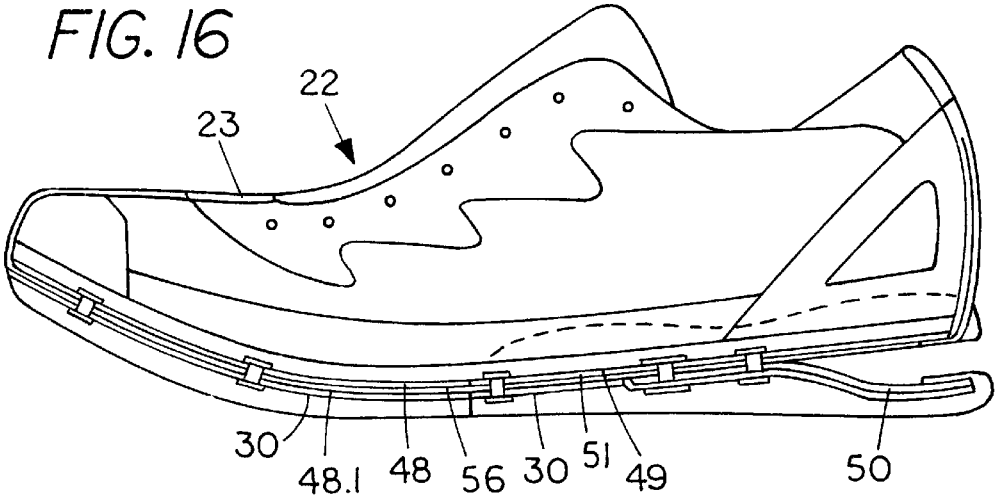
FIG. 16 is a side view of an alternate article of footwear generally similar to that shown in FIG. 4, with parts broken away, having fewer layers underlying the superior spring element.

It is also possible for heterogeneous materials to be used in making the backing 30 and ground engaging portion 53 of the outsole 43. For example, Advanced Elastomer Systems has developed a formulation of SANTOPRENE® which is capable of bonding to nylon. See also U.S. Pat. No. 5,709,954, U.S. Pat. No. 5,786,057, U.S. Pat. No. 5,843,268, and U.S. Pat. No. 5,906,872 granted to Lyden et al. and assigned to NIKE, Inc., all of these patents hereby incorporated by reference herein, which relate to chemical bonding of rubber to plastic materials in articles of footwear. Further, in an alternate embodiment of the present invention, the backing 30 can simultaneously comprise at least a portion of the spring element 51 of the article of footwear 22, as shown in FIG. 16. In addition, the outsole 43 can also include desired lines of flexion 54. The following U.S. Patents and some of the prior art recited therein contain teachings with respect to lines of flexion 54 in articles of footwear such as grooves, and the like: U.S. Pat. No. 5,384,973, U.S. Pat. No. 5,425,184, U.S. Pat. No. 5,625,964, U.S. Pat. No. 5,709,954, U.S. Pat. No. 5,786,057, U.S. Pat. No. 4,562,651, U.S. Pat. No. 4,837,949, and U.S. Pat. No. 5,024,007, all of these patents being hereby incorporated by reference herein.

The use of a relatively soft elastomeric material having good dampening characteristics on the ground engaging portion 53 of an outsole 43 can contribute to enhanced attenuation of the shock and vibration generated by impact events. Relatively soft elastomeric materials having good dampening characteristics tend to have interior abrasion and wear characteristics, and this can pose a practical limitation on their use in conventional articles of footwear constructed with the use of adhesives having non-renewable outsoles. However, the use of relatively soft elastomeric materials having good dampening characteristics does not pose a practical problem with respect to the preferred article of footwear 22 taught in the present application since the outsole 43 can be easily renewed and replaced. Accordingly, the preferred article of footwear 22 can provide a wearer with enhanced cushioning effects relative to many conventional articles of footwear.

The spring element 51 can be made of a resilient material such as metal, and in particular spring steel, a thermoplastic material, or alternately a preferred fiber composite material. Glass fiber, aramide or KEVLAR® fiber, or carbon fiber composite materials can be used individually, or in partial or complete combination. Glass fiber composite materials are generally available at a cost of about $5.00 per pound, whereas carbon fiber materials are generally available at a cost of about $8.00–$14.00 per pound. Glass fiber composite materials generally exhibit a lower modulus of elasticity or flexural modulus, thus less stiffness in bending as compared with carbon fiber materials, but can generally withstand more severe bending without breaking. However, the higher modulus of elasticity of carbon fiber composite materials can provide greater stiffness in bending and a higher spring rate, and reduced weight relative to glass fiber composite materials exhibiting like flexural modulus. Blends or combinations of glass fiber and carbon fiber materials are commonly known as hybrid composite materials.

Carbon fiber composite materials can be impregnated or coated with thermoplastic materials or thermoset materials. The modulus of elasticity or flexural modulus of some finished thermoplastic carbon fiber composite materials can be lower than that of some thermoset carbon fiber composite materials. For example, a sample of thermoplastic carbon fiber composite material having a relatively broad weave can have a flexural modulus in the range between 10–12 Msi, and in the range between 5–6 Msi in a finished part, whereas a "standard modulus" grade of thermoset impregnated uni-directional carbon fiber composite material can have a flexural modulus in the range of 33 Msi, and in the range between 18–20 Msi in a finished part. Also available are "intermediate modulus" carbon fiber composite materials at approximately 40 Msi, and "high modulus" carbon fiber composite materials having a flexural modulus greater than 50 Msi and possibly as high as approximately 100 Msi. Accordingly, in order the achieve a desired flexural modulus, a thicker and heavier portion of thermoplastic carbon fiber composite material would normally be required relative to a thermoset impregnated uni-directional carbon fiber composite material.

Impregnated carbon fiber composite materials are commonly known as "prepreg" materials. Such materials are available in roll and sheet form and in various grades, sizes, types of fibers, and fiber configurations, but also with various resin components. Various known fiber configurations include so-called woven, plain, basket, twill, satin, uni-directional, multi-directional, and hybrids. Prepreg carbon fiber composite materials are available having various flexural modulus, and generally, the higher the modulus the more expensive is the material. A standard modulus uni-directional prepreg peel-ply carbon fiber composite material made by Cape Composites, Inc. of San Diego, Calif. can be suitable for use. Such prepreg material can have a thickness of 0.025 mm or 0.01 inches including the peel-ply backing and 0.13 mm or 0.005 inches without. It is therefore relatively easy to predict the number of layers required in order to made a part having a known target thickness, but one must also allow for a nearly 10 percent reduction in thickness of the part due to shrinkage during the curing process. The cost of a suitable standard modulus carbon fiber composite material made or distributed by Cape Composites, Inc. is approximately $31.00 per yard, that is, 50 inches by one yard, and alternate suitable carbon fiber composite material can be purchased in the range between $8.00 and $14.00 per pound.

The desired thickness of the superior spring element 47 or anterior spring element 48 in the forefoot area 58 of an article of footwear intended for use in running when using standard modulus 33 Msi thermoset uni-directional prepreg carbon fiber composite material is at least 1.0 mm and approximately 1.25 mm or 0.049 inches for an individual weighing 100–140 pounds running at slow to moderate speeds, approximately 1.50 mm or 0.059 inches for an individual weighing 140–180 pounds running at slow to moderate speeds, and 1.75 mm or 0.0685 inches for an individual weighing 180–220 pounds running at slow to moderate speeds. When running at higher speeds, e.g., on a track and field surface, individuals generally prefer a thicker and stiffer plate relative to that selected for use at slow or moderate speeds. The perceived improvement in running economy can be on the order of at least one second over four hundred meters which corresponds to approximately two to three percent improvement in athletic performance. The superior spring element 47 or anterior spring element 48 can store energy when loaded during the latter portion of the stance phase and early portion of the propulsive phase of the running cycle, and then release that energy during the latter portion of the propulsive phase. Accordingly, the anterior spring element 48 provides not only deflection for attenuating shock and vibration associated with impact events, but can also provide a relatively high level of mechanical efficiency by storing and possibly returning in excess of 70 percent of the energy imparted thereto. In contrast, most conventional prior art athletic footwear soles including foam midsoles and rubber outsoles. have a spring to dampening ratio somewhere between 40–60 percent. The preferred article of footwear 22 can then afford a wearer with greater mechanical efficiency and running economy than most conventional prior art athletic footwear.

Further, unlike the conventional foam materials used in prior art articles of footwear such as ethylene vinyl acetate which can become compacted and take a compression set, the spring elements 51 used in the. present invention are not substantially subject to compression set degradation due to repetitive loading. The degradation of conventional foam materials can cause injury to a wearer, as when a broken down midsole results in a wearer's foot being unnaturally placed in a supinated or pronated position as opposed to a more neutral position, or when a compacted foam midsole in the forefoot area 58 causes a wearer's metatarsals to drop out of normal orientation or to unnaturally converge. Further, the quality of cushioning provided by conventional foam materials such as ethylene vinyl acetate or polyurethane rapidly degrades as the material becomes compacted and takes a compression set. In contrast, the spring elements 51 taught in the present invention do not substantially suffer from these forms of degradation, rather provide substantially the same performance and geometric integrity after extended use as when new. Further, in the event of a fatigue or catastrophic failure of a spring element, the damaged part can simply be removed and replaced.

The desired thickness of the superior spring element 47, or posterior spring element 49 for the rearfoot area 68 of an article of footwear intended for running use when using standard modulus 33 Msi thermoset uni-directional prepreg carbon fiber composite material is approximately in the range between 2.0–4.0 mm, and in particular, at least 2.0 mm, and about 2.25 mm or 0.0885 inches for an individual weighing between 100–140 pounds, about 2.5 mm or 0.0985 inches for an individual weighing between 140–160 pounds, about 2.75 mm or 0.108 inches for an individual weighing between 160–180 pounds, about 3.0 mm or 0.118 inches for an individual weighing between 180–200 pounds, and about 3.25 mm or 0.1275 inches for an individual weighing between 200–225 pounds.

It can be advantageous for the sake of robustness that the thickness of the inferior spring element 50 be equal to, or slightly greater than that if the corresponding superior spring element 47 or posterior spring element 49 in the rearfoot area 68, as the inferior spring element 50 has a more complex curved shape and is subject to direct repetitive impact events. Accordingly, the desired thickness of the inferior spring element 50 for an article of footwear for running use when using standard modulus 33 Msi thermoset uni-directional prepreg carbon fiber material is approximately in the range between 2.0 4.0 mm, and in particular, about 2.5 mm or 0.0985 inches for an individual weighing between 100–120 pounds 2.75 mm or 0.08 inches for an individual weighing between 120–140 pounds, 3.0 mm or 0.118 inches for an individual weighing between 140–160 pounds, 3.25 mm or 0.1275 inches for an individual weighing between 160–180 pounds, 3.5 mm or 0.138 inches for an individual weighing between 180–200 pounds, and 3.75 mm or 0.1475 inches for an individual weighing between 260–225 pounds. Different individuals can have different preferences with respect to the thickness and stiffness of various spring element components regardless of their body weight, and this can be due to their having different running styles or different habitual average running speeds. During normal walking activity the magnitude of the loads generated are commonly in the range between one to two body weights, whereas during normal running activity the magnitude of the loads generated are commonly in the range between two to three body weights. Accordingly, the flexural modulus of a spring element for use in an article of footwear primarily intended for walking can be reduced relative to an article of footwear intended for running, thus the thickness and/or stiffness of the spring element can be reduced.

When the superior spring element 47 consists of a single part, the thickness can vary and be tapered from the posterior side 34 to the anterior side 33, that is, the part can gradually become thinner moving in the direction of the anterior side 33. This can be accomplished by reducing the number of layers during the building of the part and/or with the use of compressive forces during the molding or curing process. When the superior spring 47 consists of two parts, e.g., an anterior spring element 48 and a posterior spring element 49, the parts can be made in different thickness. Alternately, the posterior spring element 49 can be made of a higher modulus material having a given thickness, and the anterior spring element 48 can be made of a lower modulus material having the same thickness, thus the two parts can have the same thickness but nevertheless provide different and desired spring and dampening characteristics.

Alternately, the number of fiber composite layers, the type of fiber and resin composition of the layers, the inclusion of a core material, and the geometry and orientation of the layers, can be varied so as to create areas of differential stiffness in a spring element 51. For example, the inferior spring element 50 can project from the superior spring element 47 with the flexural axis 59 orientated consistent with at transverse axis, that is at approximately 90 degrees with respect to the longitudinal axis 69 provided that the aforementioned variables concerning the fiber composite layers are suitably engineered so as to render the medial side 35 of the inferior spring element 50 approximately 2–3 times stiffer than the lateral side 36, that is, in an article of footwear intended for walking or running activity.

Figure 9:
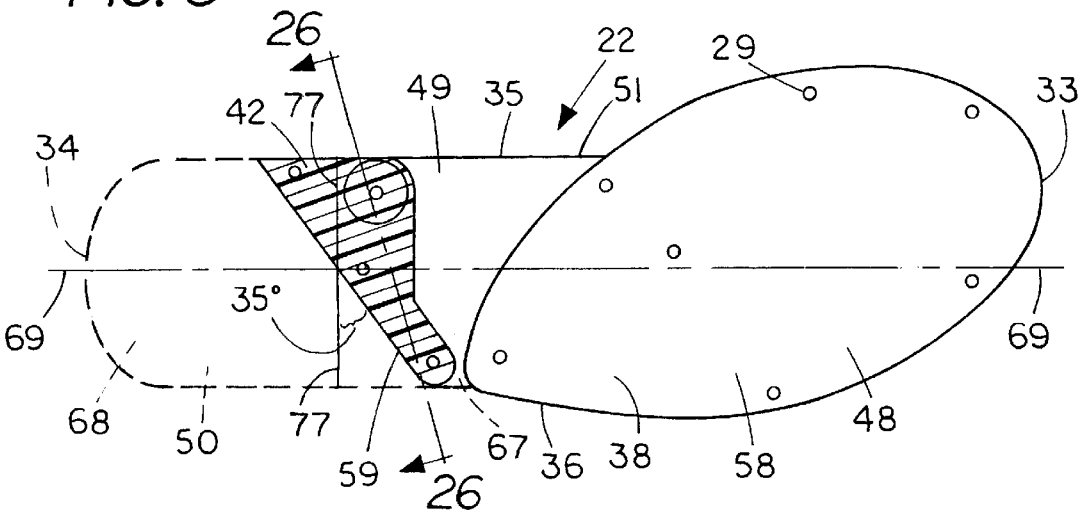
FIG. 9 is a bottom view of the article of footwear shown in FIG. 3, with the outsole elements being removed to reveal the anterior spring element, posterior spring element and inferior spring element.
Figure 10:
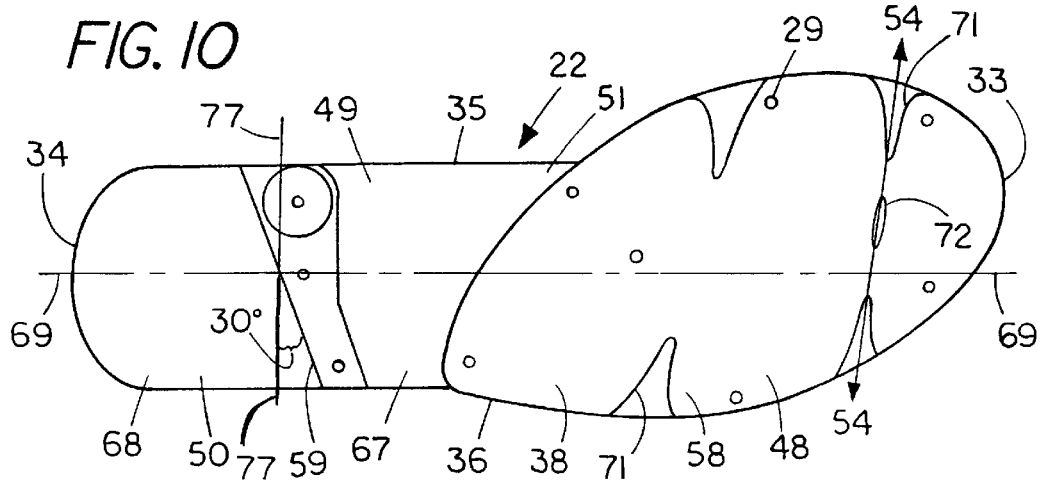
FIG. 10 is a bottom view of the article of footwear similar to that shown in FIG. 9, with the outsole elements being removed to reveal the anterior spring element, posterior spring element and an inferior spring element having an alternate configuration.

Further, the configuration of a spring element 51, and in particular, an inferior spring element 50 having an flexural axis 59 orientated at approximately 90 degrees with respect to the longitudinal axis 69, can be configured so as to provide differential stiffness. For example, a portion of a spring element 51 can include transverse or longitudinal slits, notches, openings, a core material or reduced thickness so-as to exhibit areas of differential stiffness, as shown in FIG 10. U.S. Pat. No. 5,875,567, hereby incorporated by reference herein, recites several configurations and methods for achieving differential stiffness in the midfoot area 67 or rearfoot area 68 of an article of footwear. However, the projection of exposed portions of a spring element beyond the sides of a sole, as recited and shown in U.S. Pat. No. 5,875,567, could result in injury to the medial side of a wearer's leg during running. Further, the method and process recited therein relating to grinding or otherwise removing portions of a spring element for creating differential stiffness is not considered practical or economical with regards to mass produced articles of footwear. In addition, given the common orientation of the foot of a wearer who would be characterized as a rearfoot striker during foot strike, an inferior spring element 50 having an flexural axis 59 orientated at constent with transverse axis 77 at 90 degrees with respect to the longitudinal axis 69 is not so advantageously disposed to receive repetitive loading and exhibit robustness during its service life relative to an inferior spring element 50 having an flexural axis 59 deviated from the transverse axis 77 in the range between 10 and 50 degrees, as shown in FIGS. 9 and 10. In this regard, the foot of a wearer characterized as a rearfoot striker i's normally somewhat dorsiflexed, supinated and abducted during footstrike, as recited; in U.S. Pat. No. 5,425,184, and U.S. Pat. No. 5,625,964, hereby incorporated by reference herein. Accordingly, it can be advantageous for the flexural axis 59 of the inferior spring element 50 to be deviated from the transverse axis 77 in the range between 10 and 30 degrees in an article of footwear which is intended for walking use, or use by runners who tend to supinate during the braking and stance phases of the running cycle and for the flexural axis 59 of the inferior spring element 50 to be deviated from the transverse axis 77 in the range between 30 and 50 degrees in an article of footwear, intended for use by runners who tend to pronate during the braking and stance phases of the running cycle. Other teachings having possible merit relating to differential stiffness in the rearfoot area of an article of footwear include, e.g., U.S. Pat. No. 4,506,462, U.S. Pat. No. 4,364,189, U.S. Pat. No. 5,201,125, U.S. Pat. No. 5,197,206, and U.S. Pat. No. 5,197,207, all of these patents hereby being incorporated by reference herein.

In order to make carbon fiber composite spring elements, it can be advantageous to create a form or mold. The form or mold can be made of wood, composite material, or metal. Prototype forms or molds can be made of thin sheets of stainless steel which can be cut and bent into the desired configurations. The stainless steel can then be treated with a cleaner and appropriate release agent. For example, the stainless steel can be washed with WATERCLEAN and then dried, then given two coats of SEALPROOF sealer and dried, and finally given two coats of WATERSHELD release agent and dried, all of these products being made by Zyvax, Inc. of Boca Raton, Florida, and distributed by Technology Marketing, Inc. of Vancouver, Washington, and Salt Lake. City, Utah.

A "prepreg" uni-directional carbon fiber composite material including a peel-off protective layer that exposes a self-adhesive surface can then be cut to the approximate shapes of the desired spring element by a razor blade, scissors, cutting die, or water jet cutter. Suitable carbon fiber composite materials for use include F3(C) 50 K made by FORTAFIL, PANEX 33 made by ZOLTEK, AS4C made by HEXCEL, T300 made by TORAY/AMOCO, and the like. The individual layers of carbon fiber composite material can have a thickness of approximately 0.13 mm or 0.005 inches and be affixed to one another to build the desired thickness of the spring elements, but allowing for a reduction of approximately 10 percent due to shrinkage which commonly takes place during the curing process. The individual layers can be alternated in various orientations, e.g., some can be orientated parallel to the length of the desired spring element, and others inclined at 45 degrees to the left or right, or at 90 degrees. The stiffness in bending exhibited by the: spring element in various orientations can thereby be engineered by varying the number, type, and orientation of the fiber composite layers.

Once the spring element components have been built by adhering the desired number, type, and orientation of glass or carbon fiber composite layers together, the spring element can be rolled or placed under pressure and applied to the stainless steel prototype form or mold When making prototype spring elements, the carbon fiber composite lay-up including the stainless steel form or mold can be wrapped in a peel ply or perforated release film such as Vac-Pak E 3760 or A 5000 Teflon® FEP, then wrapped in a bleeder such as A 3000 Resin Bleeder/Breather or RC-3000-10A polyester which will absorb excess resin which could leach from the spring elements during curing. This assembly can then be enclosed in a vacuum bagging film, e.g., a Vak-Pak® Co-Extruded Nylon Bagging Film such as Vac-Pak HS 800 and ail mating edges can be sealed with the use of a sealant tape such as Schnee Morehead vacuum bag tacky tape, or RAP RS200. A vacuum valve can be installed in functional relation to the vacuum bagging film before the vacuum bag is completely sealed. The vacuum valve can be subsequently connected to an autoclave vacuum hose and a vacuum pump, and the assembly can be checked for leaks before placing it in an oven for curing. The entire assembly, while under constant vacuum pressure, can then be placed into an oven and heated at a temperature of approximately 250 degrees Fahrenheit for one to two hours in order to effect setting and curing of the carbon fiber composite spring elements. Upon removal from the oven and cooling, the vacuum bag can be opened and the cured carbon fiber composite spring elements can be removed from within the bleeder and the peel ply or release film, and separated from the stainless steel form or mold. The spring element parts can then possibly be cut or trimmed with a grinder or with the use of water jet cutting equipment, then the fasteners 29 can be affixed and the spring element installed in functional relation to the upper and outsole of a prototype article of footwear.

The method of making fiber composite materials in a production setting differs depending upon whether thermoplastic or thermoset materials are being used. For example, thermoplastic carbon fiber composite materials including their resin coatings are commonly available in flat sheet stock. Parts can then be cut from these sheets using water jet cutting equipment. These parts can then be preheated for a short time in an oven in order to reach a temperature below but relatively close to the melt point of the thermoplastic material, thus rendering the part moldable. Production molds are commonly milled from aluminum, then polished and treated with a non-stick coating and release agent. The cost of a single aluminum production mold is approximately $2,500. The parts can then be placed into a relatively cold mold and subjected to pressure as the part is permitted to cool. The parts can then be removed and inspected for possible use. One manufacturer of thermoset fiber composite parts is Performance Materials Corporation of 1150 Calle Suerte, Camarillo, California 93012.

The production method and process is different when a thermoset carbon fiber composite uni-directional prepreg material is being used to make a desired part. The uncured layered thermoset part is commonly placed into an aluminum mold which has been preheated to a desired temperature. The mold is closed and the part is then subjected to both heat and pressure. In this regard, the set and cure time of thermoset fiber composite materials is temperature dependent. Generally, the set and cure time for thermoset parts will be about one hour given a temperature of 250 degrees Fahrenheit. However, it is possible for thermoset parts to reach their gel state and take a set, whereupon the shape of the part will be stable, in about one half hour given a temperature of 270 degrees Fahrenheit, in about fifteen minutes given a temperature of 290 degrees Fahrenheit, or in about seven minutes given a temperature of 310 degrees Fahrenheit. Having once reached their gel state and taken a set, the thermoset parts can then be removed from the mold. The parts can later be placed in an oven and subjected to one to two hours of exposure to a temperature of 250 degrees Fahrenheit in order to complete the curing process. One manufacturer of thermoset fiber composite parts is Quatro Composites of 12544 Kirkham Court, Number 16, Poway, California 92064.

Figure 2:
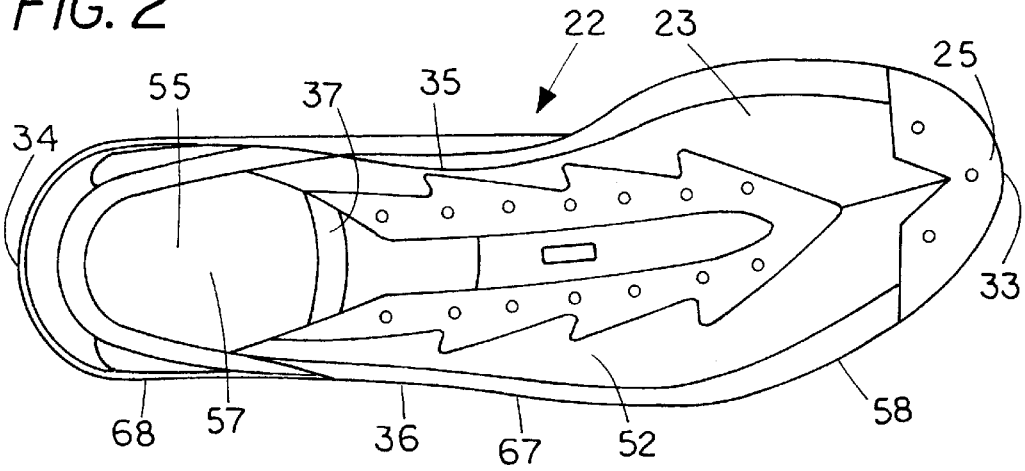
FIG. 2 is a top view of the article of footwear shown in FIG. 1.

FIG. 2 is a top view showing the superior side 37 of the article of footwear 22 shown in FIG. 1. Shown are the tip 25, vamp 52, insole 55, anterior side 33, posterior side 34, medial side 35, and lateral side 36 of the upper 23 of the article of footwear 22. Also shown is the forefoot area. 58, midfoot area 67, rearfoot area 68, and position approximately corresponding to the weight bearing center of the heel 57.

Figure 3:
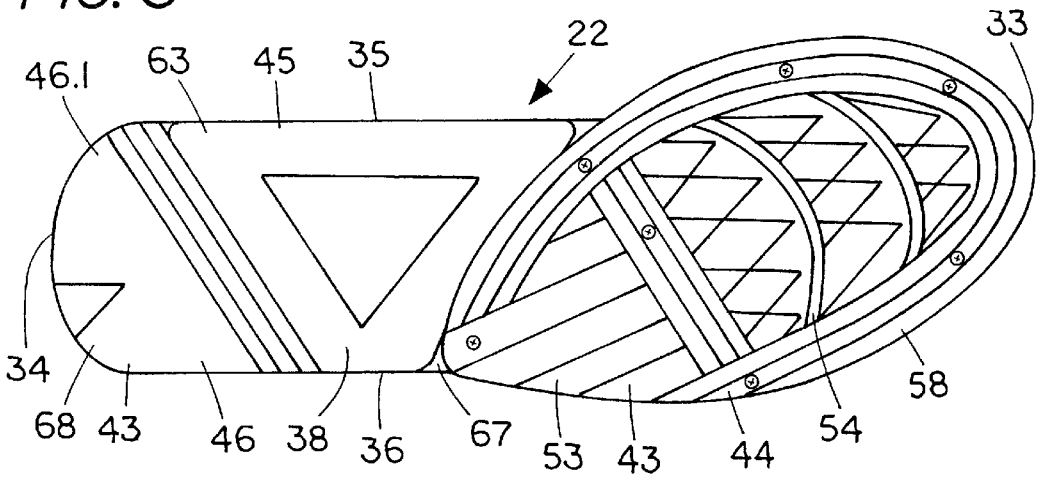
FIG. 3 is a bottom view of the article of footwear shown in FIG. 1.

FIG. 3 is a bottom view showing the inferior side 38 of the article of footwear 22 shown in FIG. 1. Shown is an outsole 43 having a tread or ground engaging surface 53 consisting of anterior outsole element 44 that includes lines of flexion 54, and a posterior outsole element 46 that extends substantially within the midfoot area 67 and rearfoot area 68. Alternately, posterior outsole element 46 can be made in two portions, that is, a posterior outsole element 46.1 positioned adjacent the posterior side 34 in the rearfoot area 68, and a stabilizer 63 having a generally triangular shape positioned substantially in the midfoot area 67. For the sake of brevity, both options have been shown simultaneously in FIG. 3. It can be readily understood that stabilizer 63 can be made in various configurations, and various different stiffness in compression options can be made in order to optimize desired performance characteristics such as cushioning and stability for an individual wearer, or a target population of wearers. In this regard, a stabilizer 63 can include a foam material, gas filled bladders, viscous fluids, gels, textiles, thermoplastic materials, and the like.

FIG. 4 is a medial side view of the article of footwear 22 shown in FIG. 1, with parts broken away. Shown in FIG. 4 is a two part: outsole 43 consisting of anterior outsole element 44, and posterior outsole element 46, each having a backing 30. Also shown are the upper 23, including a tip 25, vamp 52, heel counter 24, fasteners 29, and insole 31. The insole 31 can be made of a foamed or blow neoprene rubber material including a textile cover and having a thickness of approximately 3.75 mm, or a SORBOTHANE®, or PORON® polyurethane foam material including a textile cover. The insole 31 preferably includes a light cure material for providing a custom fit in accordance with U.S. Pat. No. 5,632,057 granted to the present inventor, hereby incorporated by reference herein. The superior spring element 51 underlies the insole 31 and can be configured to approximate the shape of the insole 31 and last bottom about which the upper 23 can be affixed during the manufacturing process, or alternately, to a soft computer software three dimensional model relating to the configuration and pattern of the upper 23 of the article of footwear.

The spring element 51 can consist of a plurality of portions, and preferably three portions, an anterior spring element 48, a posterior spring element 49, and an inferior spring element 50which can be affixed together in functional relation, e.g., with the use of fasteners 29, and the like. The anterior spring element 48 can underlay a substantial portion of the forefoot area 5.8 and is preferably affixed to the posterior spring element 49 in the forefoot area 58 or midfoot area 67 posterior of a position in the range between approximately 60–70 percent of the length of the upper 23 of the article of footwear 22 as measured from the posterior side 34, that is, a position posterior of the metatarsal-phalangeal joints of a wearer's foot when the article of footwear 22 is donned. The metatarsal-phalangeal joints are located at approximately 70 percent of foot length on the medial side 35 of the foot, and at approximately 60 percent of foot length on the lateral side 36 of the foot. Accordingly the anterior spring element 48 can underlay the metatarsal-phalangeal joints of the foot and energy can temporarily be stored and later released to generate propulsive force when the anterior spring element 48 undergoes bending during the stance and propulsive phases of the running cycle. The anterior spring element 48 can be selectively and removably attached and renewed in the event of damage or failure. Further, a wearer can select from anterior spring elements 48 having different configurations and stiffness, and therefore customize the desired stiffness of the anterior spring element 48 in an article of footwear 22. For example, different individuals having different body weight, running styles, or characteristic running speeds could desire anterior spring elements 48 having different stiffness.

Likewise, the superior spring element 47 or posterior spring element 46 can be selectively and removably affixed to the inferior spring element 50 in the rearfoot area 68 or midfoot area 67 of the article of footwear 22. Accordingly the superior spring element 47 or posterior spring element 49 can underlay a substantial portion of the wearer's rearfoot and perhaps a portion of the wearer's midfoot and energy can be stored during the braking and stance phases of the running cycle and released in the later portion of the stance and propulsive phases of the running cycle to provide propulsive force. The anterior most portion of wearer's rearfoot on the lateral side of the foot is consistent with the junction between the calcaneus and cuboid bones of the foot which is generally in the range between 25–35 percent of a given foot length and that of a corresponding size upper 23 of an article of footwear 22. The superior spring element 47 or posterior spring element 49, and inferior spring element 50 can be selectively and removably attached and renewed in the event of failure Further a wearer can select from superior spring elements 47 or posterior spring elements 49, and inferior spring elements 50 having different configurations and stiffness, and therefore customize the desired stiffness of these spring elements in an article of footwear 22. For example, different individuals having different weight, running styles, or characteristic running speeds could desire to select superior spring elements 47 or posterior spring elements 49, and inferior spring elements 50 having different stiffness.

Accordingly, the spring element 51 of a preferred. article of footwear can consist of three portions, an anterior spring element 48 which is positioned anterior of at least approximately 70 percent of the length-of the upper 23 of the article of footwear 22 as measured from the posterior side 34, a posterior spring element 49 which extends anteriorly from proximate the posterior side 34 of the upper 23 of the article of footwear 22 and is affixed in functional relation to the anterior spring element 48, and an inferior spring element 50 which is affixed in functional relation to the posterior spring element 49. The inferior spring element 50 projects rearwards and downwards and extends beneath a substantial portion of the rearfoot area 68 of the article of footwear 22, that is, inferior spring element 50 can extend posterior of a position which corresponds to approximately 25–35 percent of the length of the upper 23 as measured from the posterior side 34. Alternately, the spring element 51 can be formed in two portions or a single part.

The elevation of the wearer's foot in the rearfoot area 68 measured under the weight bearing center of a wearer's heel 57 is preferably less than 30 mm, and is approximately 26 mm in a size 11 men's article of footwear 22, as shown in FIG. 4. The elevation of the wearer's foot in the forefoot area 58 measured under the ball of the foot proximate the metatarsal-phalangeal joints is preferably less than 20 mm, and is approximately 16 mm in a size 11 men's article of footwear, as shown in FIG. 4. The difference in elevation between the forefoot area 58 when measured under the ball of the foot and the rearfoot area 68 when measured under the weight bearing center of a wearer's heel 57 is preferably in the range between 8–12 mm, and is approximately 10 mm, as shown in FIG. 4.

The preferred maximum amount of deflection as between the superior spring element 47 or posterior spring element 49 and the inferior spring element 50 is in the range between 8–15 mm for most athletic footwear applications. As shown in FIG. 4, the maximum amount of deflection possible as between posterior spring element 49 and inferior spring element 50 is approximately 10 mm and this amount of deflection is generally preferred for use in the rearfoot area 68 of a running shoe. It can be advantageous from the standpoint of injury prevention that the elevation of the rearfoot area 68 minus the maximum amount of deflection permitted between the superior spring element 47 or posterior spring element 49 and the inferior spring element 50 be equal to or greater than the elevation of the forefoot area 58. It can also be advantageous as concerns the longevity of the working life of the spring element 51 that the amount of deflection permitted be equal to or less than approximately 75% the maximum distance between the proximate opposing sides of the spring element 51, that is, as between the inferior surface of the superior spring element 47 or posterior spring element 49 and the superior surface of the inferior spring element 50.

The preferred amount of deflection or compression under the wearer's foot in the forefoot area 58 is approximately 4–6 mm, and such can be provided by an insole 31 having a thickness of 3.75 mm in combination with an anterior outsole element 44 having a total thickness of 6.5 mm including a backing 30 having a thickness of approximately 1.5 mm and a tread or ground engaging portion 53 having a thickness of approximately 5 mm, and in particular, when the ground engaging portion 53 is made of a relatively soft and resilient material having good traction, and shock and vibration dampening characteristics. For example, a foamed natural or synthetic rubber or other elastomeric material can be suitable for use. If hypothetically, an outsole material having advantageous traction, and shock and vibration dampening characteristics only lasts 200 miles during use, that is, as opposed to perhaps 300 miles associated with a harder and longer wearing outsole material, this does not pose a, practical problem, as the outsole 43 portions can be easily renewed in the present invention, whereas a conventional article of footwear would normally be discarded. Accordingly, it is possible to obtain better traction, and shock and vibration dampening characteristics in the present invention, as the durability of the outsole 43 portions is not such an important criteria.

Figure 5:
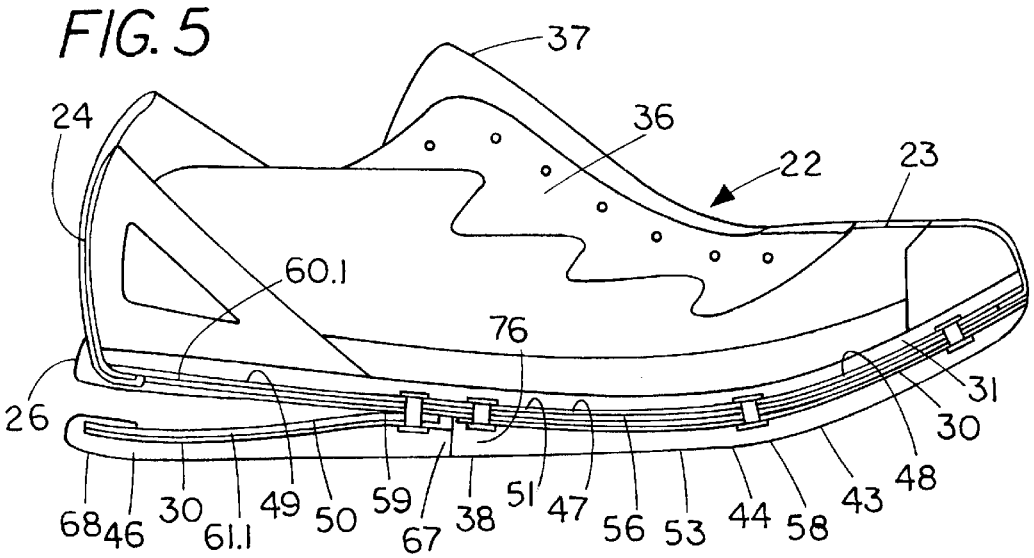
FIG. 5 is a lateral side view of the article of footwear shown in FIG. 1, with parts broken away.

FIG. 5 is a lateral side view of the article of footwear 22 shown in FIG. 1, with parts broken away. Shown in dashed lines is the medial aspect of the inferior spring element 50. Also shown is the flexural axis 59 which can be deviated in the range between 10 and 50 degrees of from the transverses axis 77 of an article of footwear 22. It can be advantageous that the flexural axis 59 be deviated from the transveres axis 77 in the range between 10–30 degrees in an article of footwear intended for use in walking, and generally in the range between 30–50 degrees in an article of footwear intended for use in running. As shown in FIGS. 4 and 5, the flexural axis 59 is deviated about 35 degrees from the transverse axis 77 of the article of footwear 22.

It can be readily understood that posterior of the flexural axis 59 the length of the superior lever arm 60 and inferior lever arm 61 formed along the medial side 35 of the superior spring element 47 or posterior spring element 49 and the inferior spring element 50 are shorter than the length of the corresponding superior lever arm 60.1 and inferior lever arm 61.1 formed along the lateral side 36 of the superior spring element 47 or posterior spring element 49 and the inferior spring element 50. Accordingly, when the inferior spring element 50 is affixed in functional relation to the superior spring element 47 or posterior spring element 49 and is subject to compressive loading, the inferior spring element 50 exhibits less stiffness in compression at the lateral and posterior corner, and increasing stiffness in compression both anteriorly and laterally. Again, it can be advantageous for enhancing rearfoot stability during walking or running that the spring element 51 including inferior spring element 50 exhibit approximately two to three times the stiffness in compression on the medial side 35 relative to the stiffness exhibited on the lateral side 36. Further, as shown in FIGS. 4 and 5, the inferior aspect of the spring element 51 has a concave configuration in the midfoot area 67, that is, between the inferior most portion of the anterior spring element 48 in the forefoot area 58 and. the inferior most portion of the inferior spring element 50 in the rearfoot area 68. It can be readily understood that the configuration of this concavity 76 and the flexural modulus of the spring element 51, as well as the stiffness of the anterior outsole element 44, middle outsole element 45, posterior outsole element 46, anterior spacer 55, and posterior spacer 42 can be engineered to provide optimal cushioning characteristics such as deflection with respect to the midfoot area 67 and rearfoot area 68 for an individual wearer, or for a target population having similar needs and requirements.

Figure 6:
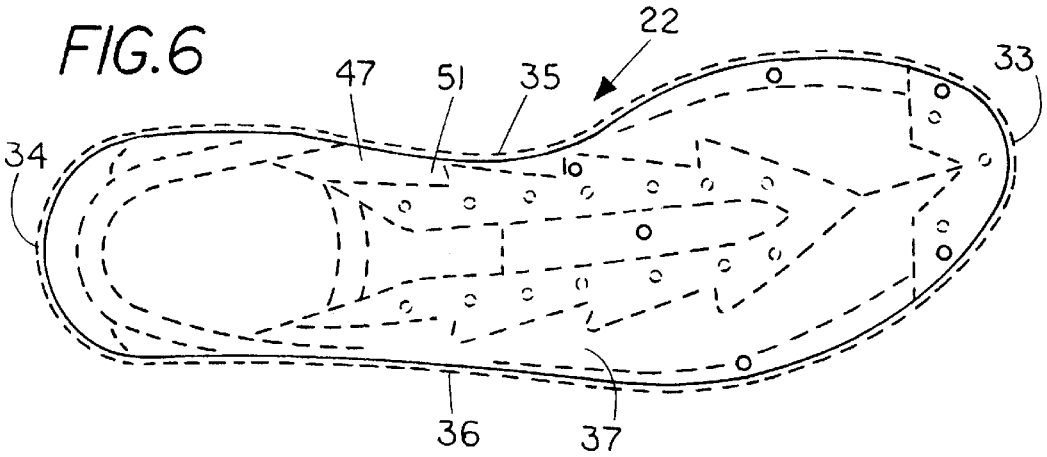
FIG. 6 is a top view of a spring element in the article of footwear shown in FIG. 2, with the upper shown in dashed lines.

FIG. 6 is a top view of a spring element 51 in the article of footwear 22 similar to that shown in FIG. 2, but having a relatively more curvedshape corresponding to a relatively more curve lasted upper 23 shown in dashed lines. Shown is a spring element 51 consisting of a single full length superior spring element 47.

Figure 7:
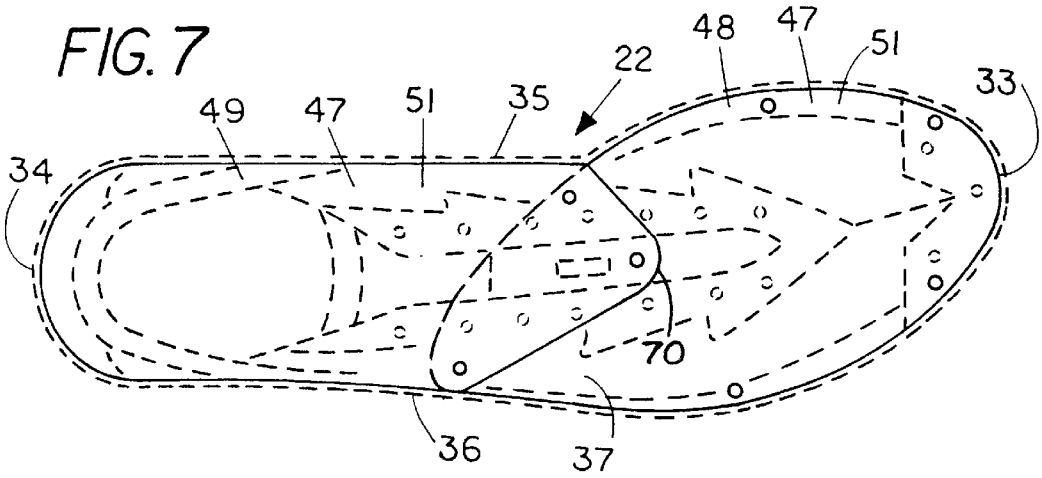
FIG. 7 is a top view of a two part spring element in the article of footwear shown in FIG. 2, with the upper shown in dashed lines.

FIG. 7 is a top view of a two part spring element 51 consisting of anterior spring element 48 and posterior spring element 49 in the article of footwear 22 shown in FIG. 2, with the upper 23 shown in dashed lines.

Figure 8:
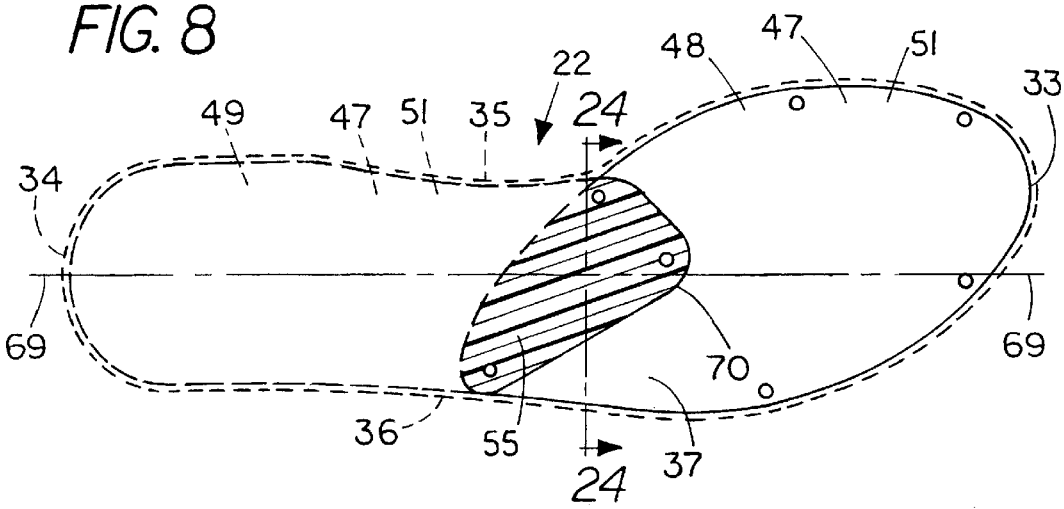
FIG. 8 is a top view of a two part spring element in an article of footwear similar to that shown in FIG. 2, but having a relatively more curve lasted upper shown in dashed lines.

FIG. 8 is a top view of a two part spring element 51 consisting of anterior spring element 48 and posterior spring element 49 in an article of footwear 22 generally similar to that shown in FIG. 2, but having a relatively more curved shape corresponding to a relatively more curve lasted upper 23 which is shown in dashed lines. The anterior spring element 48 and posterior spring element 49 can be affixed with three fasteners 29 in triangulation. The posterior spring element 48 can include a projection 70 proximate the longitudinal axis 69 of the article of footwear 22. The configuration of this projection 70 can at least partially determine the torsional rigidity of the assembled spring element 51 consisting of anterior spring element 48 and posterior spring element 49, thus the degree to which the forefoot area 58 can be rotated inwards or outwards about the longitudinal axis 69. Further, the number, dimension, and location of the fasteners 29 used to affix the anterior spring element 48 and posterior spring element 49 can affect both the flexural modulus of the superior spring element 47 along the length of the longitudinal axis 69, but also rotationally about the longitudinal axis 69, that is, the torsional modulus of the superior spring element 47. A portion of the anterior spring element 48 is shown broken away in order to reveal the optional inclusion of an anterior spacer 55 between the anterior spring element 48 and the posterior spring element 49.

As shown in FIG. 8, an anterior spacer 55 which can possibly consist of a cushioning medium having desired spring and dampening characteristics can be inserted in the area between the anterior spring element 48 and posterior spring element 49, that is, within an area of possible overlap as between the two components. The configuration and compressive, flexural, and torsional stiffness of an anterior spacer 55 can be used to modify the overall configuration and performance of a spring element 51 and article of footwear 22. In this regard, an anterior spacer 55 can have uniform height, or alternately an anterior spacer 55 can have varied height. Further, an anterior spacer 55 can exhibit uniform compressive, flexural, and torsional stiffness throughout, or alternately an anterior spacer 55 can exhibit different compressive, flexural, and torsional stiffness in different locations. These varied characteristics of an anterior spacer 55 can be used to enhance the cushioning, stability and overall performance of an article of footwear 22 for a unique individual wearer, or for a target population of wearers. For example, an anterior spacer 55 having an inclined or wedge shape can be used to decrease the rate and magnitude of pronation, supination, and inward or outward rotation of portions of a wearer's foot during portions of the walking or running gait cycled and can also possibly correct for anatomical conditions such as varus or valgus. The relevant methods and techniques for making corrections of this kind are relatively well known to qualified medical doctors, podiatrists, and physical therapists. See also the following prior art references, U.S. Pat. No. 4,399,620, U.S. Pat. No. 4,578,882, U.S. Pat. No. 4,620,376, U.S. Pat. No. 4,642,911, U.S. Pat. No. 4,949,476, and U.S. Pat. No. 5,921,004, all of these patents hereby being incorporated by reference herein. Normally, an anterior spacer 55 having an inclined wedge shape that increases in height from the lateral to the medial side, or one which exhibits greater stiffness in compression on the medial side can be used to compensate for a forefoot varus condition, whereas an anterior spacer 55 having an inclined wedge shape that increases in height from the medial to the lateral side, or one which exhibits greater stiffness in compression on the lateral side can be used to compensate for a forefoot valgus condition. An individual with a profound anatomical condition such as varus or valgus, or having a history of injury would be prudent to consult with a trained medical doctor when contemplating modification to their articles of footwear. Further, an anterior spacer 55 can also have a wedge or complex curved shape along the longitudinal axis 69, that is, in the posterior to anterior orientation, and various configurations of an anterior spacer 55 can be provided which can be used to modify the amount of toe spring 62 and the overall conformance of a spring element 51 and article of footwear 22, as desired.

FIG. 9 is a bottom view of the article of footwear 22 shown in FIG. 3, with the anterior outsole element 44 and posterior outsole element 46 removed to reveal the anterior spring element 48, posterior spring element 49, and inferior spring element 50. The flexural axis 59 of inferior spring element 50 is deviated approximately 35 degrees from the transverse axis 77. This configuration can be advantageous for use by distance runners who tend to pronate during the braking and stance phases of the running cycle. Further, a portion of the inferior spring element 50 is shown broken away to reveal the optional use of a posterior spacer 42 which canliserve a role in functional relation to the inferior spring element 50 and the superior spring element 47 or posterior spring element 49 analogous to that of the anterior spacer 55 which can be used as between the anterior spring element 48 and posterior spring element 49. Further, a posterior spacer 42 can also have a wedge or complex curved shape along the longitudinal axis 69, that is, in the posterior to anterior orientation, and various configurations of a posterior spacer 42 can be provided which can be used to modify the overall conformance of a spring element 51 and article of footwear 22, as desired.

FIG. 10. is a bottom view of an alternate article of footwear 22 with the anterior outsole element 44 and posterior outsole element 46 removed to reveal anterior spring element 48, posterior spring element 49 and an alternate configuration of inferior spring element 50. The flexural axis 59 of inferior,spring element 50 is deviated approximately 20 degrees from the transveres axis 77. This configuration can be advantageous for use by walkers, or by runners who tend to supinate during the braking and stance phases of the running cycle. Also shown in FIG. 10 is the possible use of notches 71 or openings 72 in order to diminish the stiffness in bending or flexural modulus exhibited by a portion of spring element 51. The anterior spring element 48, posterior spring element 49, and inferior spring element 50 are shown affixed together in an overlapping relationship in FIGS. 9 and 10. However, it can be readily understood that various components of a spring element 51 can be affixed in function relation with the use of adhesives, mating male and female parts such as tongue and groove, or other configurations and devices known in the prior art.

Figure 11:
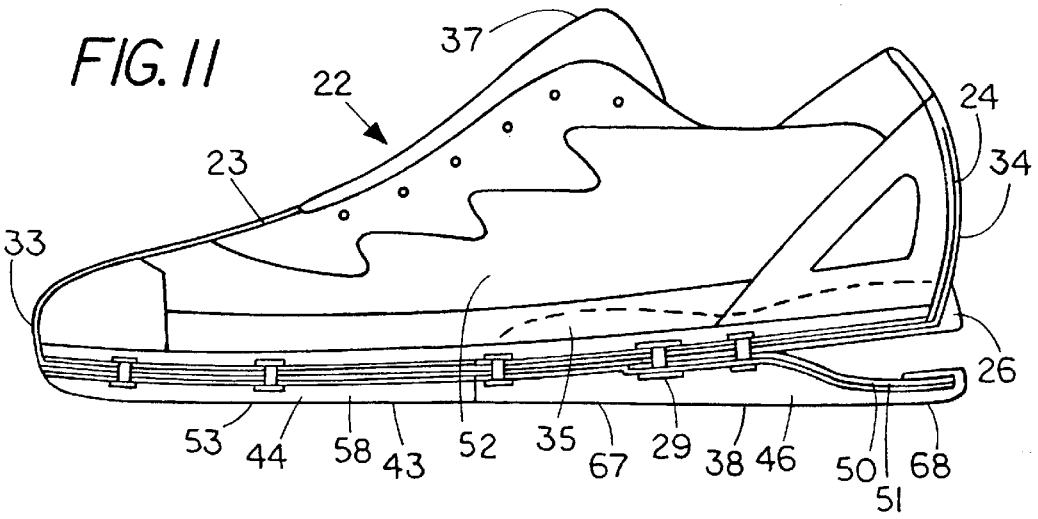
FIG. 11 is a side view of an alternate article of footwear generally similar to that shown in FIG. 1 with parts broken away, but having a forefoot area without toe spring.

FIG. 11 is a side view of an alternate article of footwear 22 generally similar to that shown in FIG. 1, with parts broken away, but having a forefoot area 58 without substantial toe spring 62. This particular article of footwear 22 can be suitable for use in activities such as tennis, or basketball.

Figure 12:
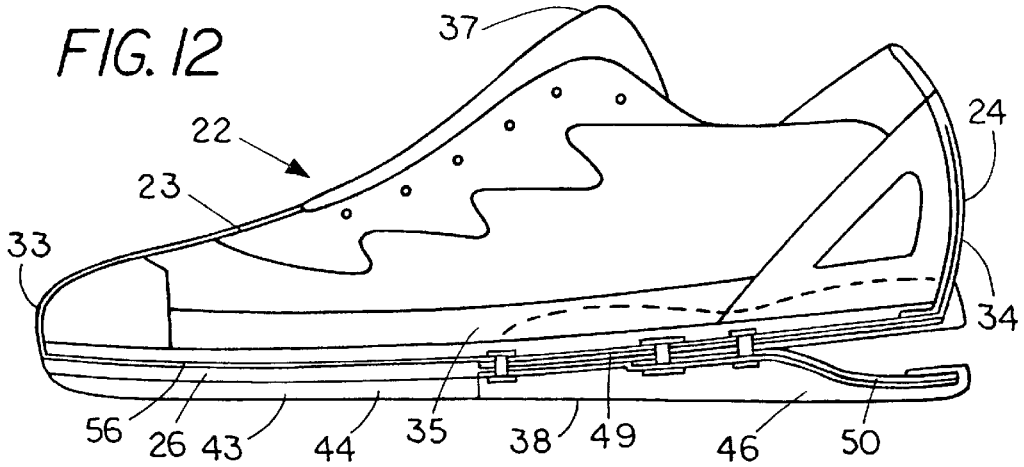
FIG. 12 is a side view of an alternate article of footwear generally similar to that shown in FIG. 1, with parts broken away, but having a forefoot area including an outsole, foam midsole, and upper affixed together with an adhesive.

FIG. 12 is a side view of an alternate article of footwear 22 generally similar to that shown in FIG. 11, with parts broken away, having a forefoot area 58 without substantial toe spring 62, but including an anterior outsole element 44, foam midsole 26, and upper 23 which are affixed together with the use of adhesives.

Figure 13:
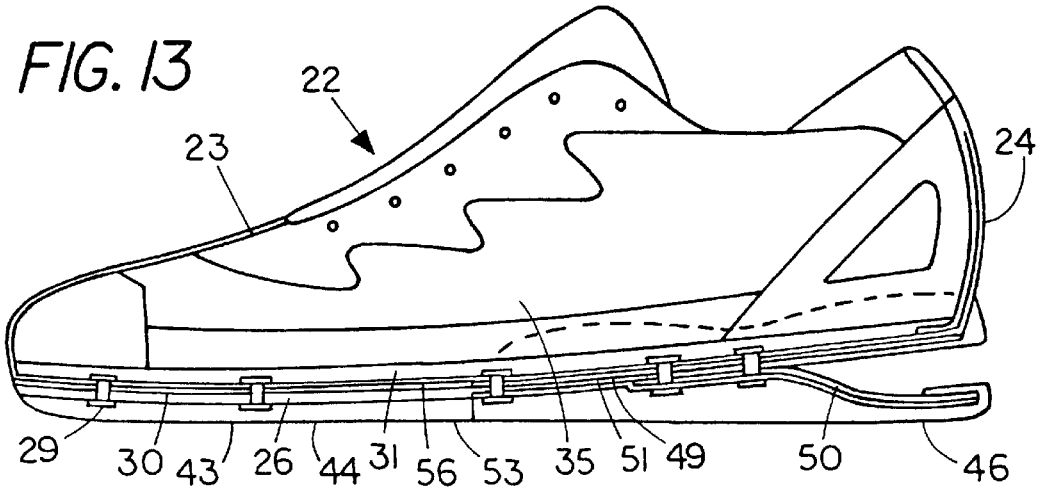
FIG. 13 is a side view of an alternate article of footwear generally similar to that shown in FIG. 12, with parts broken away, but having a forefoot area including a detachable outsole and foam midsole.

FIG. 13 is a side view of an alternate article of footwear 22 generally similar to that shown in FIG. 12, with parts broken away, having a forefoot area 58 without substantial toe spring 62, but including a detachable anterior outsole element 44 and foam midsole 26.

Figure 14:
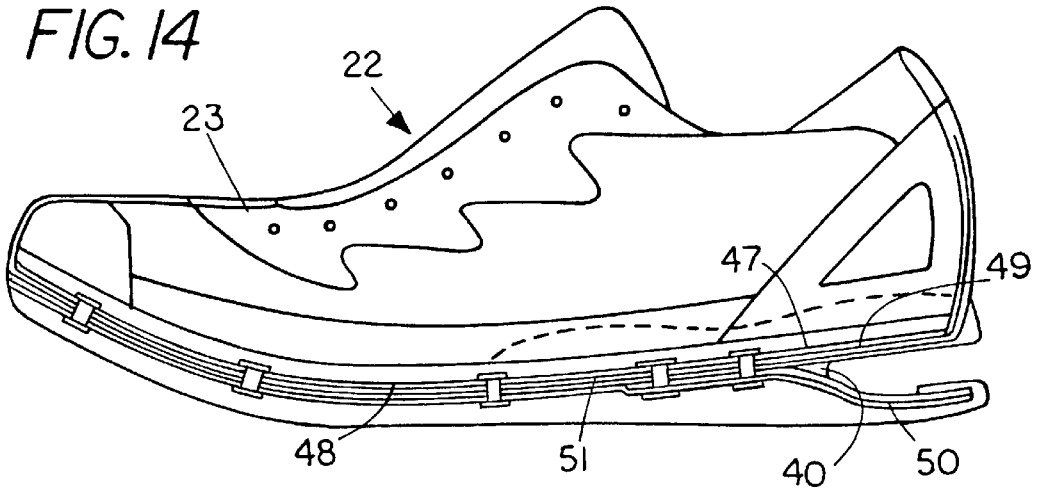
FIG. 14 is a side view of an alternate article of footwear similar to that shown in FIG. 4, with parts broken away, further including a spring guard.
Figure 18:
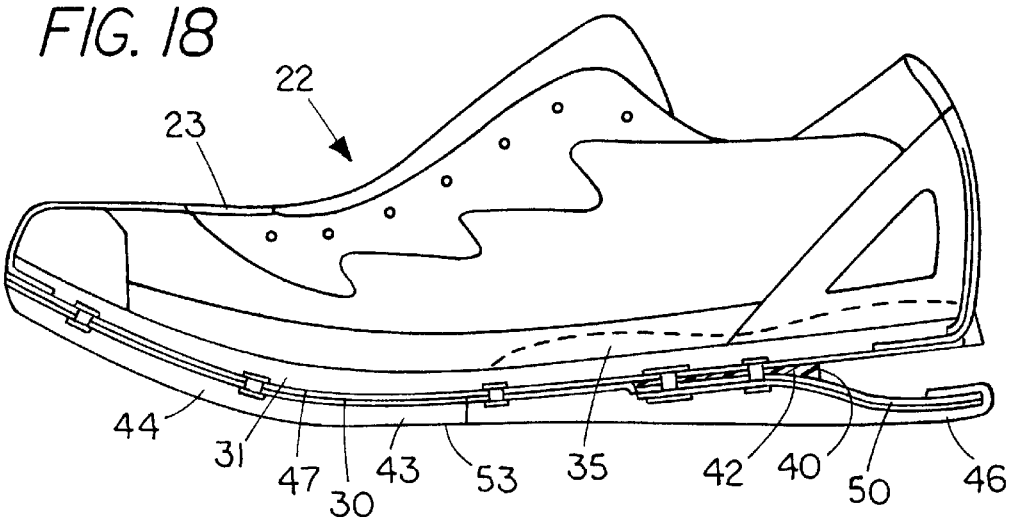
FIG. 18 is a side view of an alternate article of footwear generally similar to that shown in FIG. 17 further including a posterior spacer including a spring guard.
Figure 20:
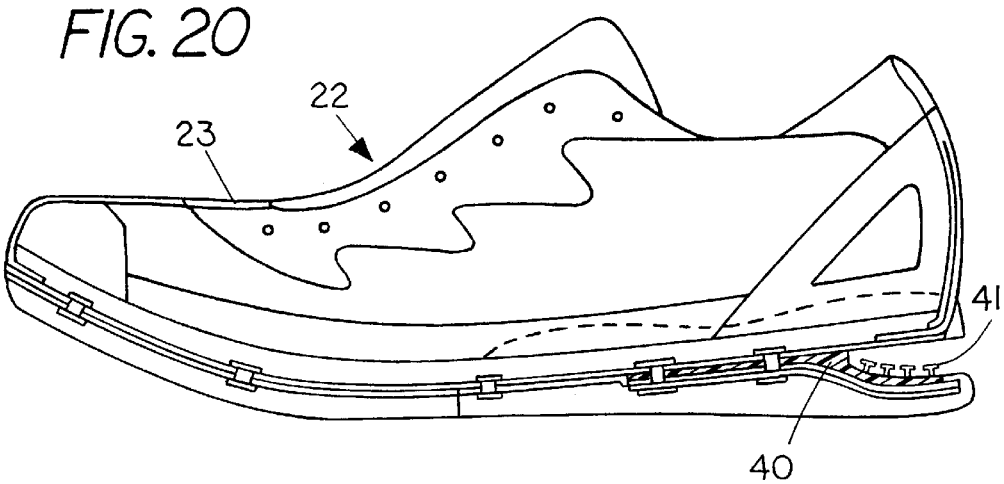
FIG. 20 is a side view of an alternate article of footwear generally similar to that shown in FIG. 19, further including a spring guard including a plurality of vibration decay time modifiers.

FIG. 14 is a side view of an alternate article of footwear 22 similar to that shown in FIG. 4, further including a spring guard 40. The spring guard 40 can be made of a relatively soft resilient material such as a foam material, or a natural or synthetic rubber. The spring guard 40 can prevent foreign matter from becoming lodged in the area proximate the junction of the superior spring element 47 or posterior spring element 49 and the inferior spring element 50, thus can prevent damage to spring element 51. The spring guard 40 can be affixed to the superior spring element 47 or posterior spring element 49, or to the inferior spring element 50, or to both portions of the spring element 51. Alternately, the spring guard 40 can form a portion and extension of posterior spacer 42, as shown in FIG. 18. Further, the spring guard 40 can also serve as a vibration decay time modifier 41, as shown in FIG. 20.

In the article of footwear shown in FIG. 14, when a line is drawn parallel to the ground support surface and tangent to the inferior surface of the superior spring element 47 in the forefoot area 58, the approximate slope of the superior spring element 47 as it extends posteriorly is approximately five degrees. When affixed in functional relation to the superior spring element 47 or posterior spring element 49, the inferior spring element 50 projects downwards and rearwards therefrom before attaining the desired amount of separation between the components which at least partially determines the maximum amount of deflection that the resulting spring element 51 can provide. As shown in FIG. 14 and other drawing figures, once the inferior spring element 50 descends and attains the desired amount of separation the inferior spring element 50 extends posteriorly in a substantially parallel relationship with respect to the corresponding overlaying portion of the superior spring element 47 or posterior spring element 49. Accordingly, after descending from proximate the superior spring element 47 or posterior spring element 49 and establishing the desired amount of separation the inferior spring element 50 does not recurve or curl back upwards as it extends towards the posterior side 34 of the article of footwear 22. It is known in prior art articles of footwear, and can also be advantageous in the present invention for a portion of the outsole 43 near the posterior side 34, and in particular, proximate the posterior side 34 and lateral side 36 corner, to be sloped upwards in the range between 5–15 degrees, and in particular, approximately 12–13 degrees. However, the configuration of the article of footwear 22, e.g., the amount of toe spring 62 and the aforementioned slope of the superior spring element 47 can influence or determine the amount of slope which is advantageous to incorporate in this portion of the outsole 43.

Figure 15:
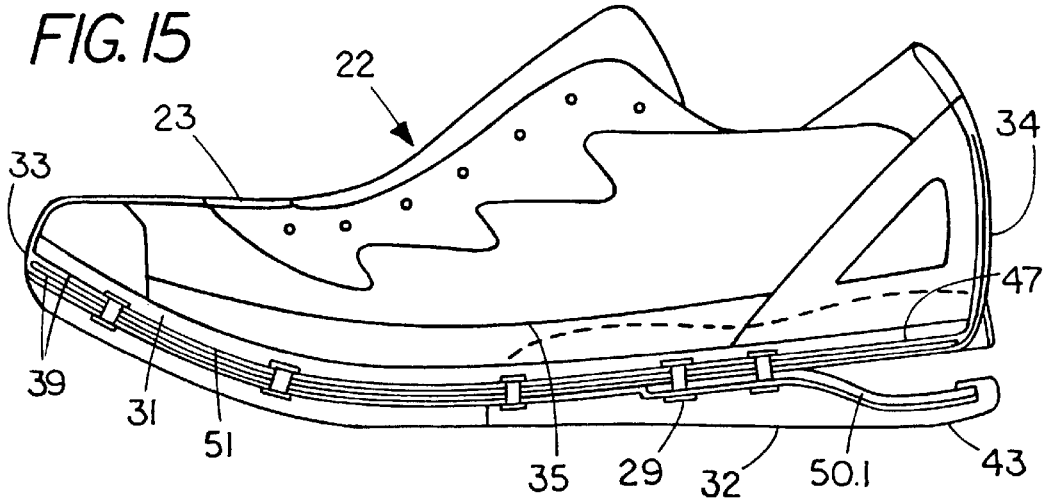
FIG. 15 is a side view of an alternate article of footwear generally similar to that shown in FIG. 4, with parts broken away, having a upper including a sleeve for accommodating a spring element.

FIG. 15 is a side view of an alternate article of footwear 22 generally similar to that shown in FIG. 4, with parts broken away, having a upper 23 including a sleeve 39 for accommodating the superior spring element 47. The sleeve 39 can be formed in a portion of the upper 23 inferior to the insole 31, and can possibly consist of portion of the t-sock 56. The spring element 51 can include an inferior spring element 50, and a superior spring element 47 that can include an anterior spring element 48 and a posterior spring element 49. The superior spring element 47 can be positioned within sleeve 39, thus at least partially retaining the superior spring element 47 in functional relation to the upper 23 of the article of footwear 22.

Further, in contrast with the configuration of inferior spring element 50 shown in FIG. 14, an alternate inferior spring element 50.1 is shown in FIG. 15. The alternate inferior spring element 50.1 descends from proximate the superior spring element 47 or posterior spring element 49 and attains maximum separation therefrom. The inferior spring element 50.1 can then possibly extend posteriorly in a parallel relationship with respect to the overlaying superior spring element 47. However, the inferior spring element 50.1 then recurves or curls up slightly as the inferior. spring element 50.1 extends towards the posterior side 34 of the article of footwear 22. In particular, the inferior spring element 50.1 curls up slightly in the range between approximately 5–15 degrees as it extends towards the posterior side 34 and lateral side 36 corner of the sole 32 of the article of footwear 22.

FIG. 16 is a side view of an alternate article of footwear 22 generally similar to that shown in FIG. 4, with parts broken away. However, this alternate embodiment does not include an additional covering such as a coating, textile, or outsole 43 on the inferior side of the upper 23, as shown in FIG. 4. Accordingly, the inferior side of the upper 23 is in direct contact with the superior side of the backing 30 of the outsole 43, that is, anterior outsole element 44 and posterior outsole element 46 when the article of footwear 22 is assembled. Further, in an alternate embodiment of the present invention, the backing 30 of an outsole 43 can be made of a material having sufficient flexural modulus and resilience as to simultaneously serve as a spring element of the article of footwear, as shown in FIG. 16. Accordingly, the anterior spring element can consist of two portions, anterior spring element 48, and anterior spring element 48.1, which also serves as the backing 30 of anterior outsole element 44.

Figure 17:
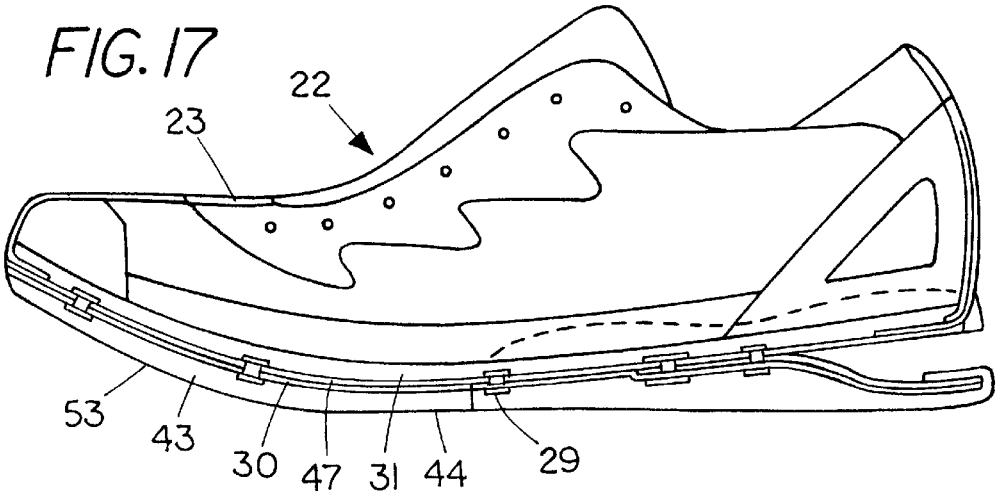
FIG. 17 is a side view of an alternate article of footwear generally similar to that shown in FIG. 4, with parts broken away, having a upper affixed to a spring element.

FIG. 17 is a side view of an alternate article of footwear 22 generally similar to that shown in FIG. 4, having a upper 23 affixed to superior spring element 47, with parts broken away. The upper 23 is affixed to the top or superior surface of superior spring element 47, thus the superior spring element 47 can be exposed on its bottom or inferior surface. Accordingly, the superior surface of the outsole 43 portions including backing 30 can be placed in direct contact with the superior spring element 47 when they are affixed into position.

FIG. 18 is a side view of an alternate article of footwear 22 similar to that shown in FIG. 17, further including a posterior spacer 42. As shown in FIG. 18, a posterior spacer 42 can include a spring guard 40. As shown in FIG. 20, a spring guard 40 can further include a vibration decay time modifier 41. The posterior spacer 42 can serve to at least partially isolate the superior spring element 47, upper 23 and wearer from the transmission of shock and vibration which could be imparted by the inferior spring element 50 and posterior outsole element 46 caused by an impact event.

It can be readily understood that a posterior spacer 42 can serve a purpose analogous to that of anterior spacer 55, and vice-versa. Accordingly, a posterior spacer 42 can consist of a cushioning medium having desired spring and dampening characteristics. The posterior spacer 42 can be inserted between the inferior spring element 50 and posterior spring element 49, that is, within an area of possible overlap as between the two components. The configuration and stiffness of a posterior spacer 42 can be used to modify the overall configuration and performance of a spring element 51 and article of footwear 22. In this regard, a posterior spacer 42 can have uniform height, or alternately a posterior spacer 42 can have varied height. Further, a posterior spacer 42 can exhibit uniform compressive, flexural, or torsional stiffness throughout, or alternately can exhibit different properties in different locations. These varied characteristics of a posterior spacer 42 can be used to enhance the cushioning and/or stability of an article of footwear 22 for an unique individual wearer, or for a target population of wearers.

For example, a posterior spacer 42 having an inclined or wedge shape can be used to decrease the rate and magnitude of pronation, supination, inward or outward rotation of portions of a wearer's foot during phases of the walking or running gait cycle, and can also possibly correct for anatomical conditions such as varus or valgus. Again, the relevant methods and techniques for making corrections of this kind are relatively well known to qualified medical doctors, podiatrists, and physical therapists. Normally, a posterior spacer 42 having an inclined wedge shape that increases in height from the lateral to the medial side, or a posterior spacer 42 which exhibits greater stiffness in compression on the medial side can be used to reduce the magnitude and rate of rearfoot pronation, whereas a posterior spacer 42 having an inclined wedge shape that increases in height from the medial to the lateral side, or a posterior spacer 42 which exhibits greater stiffness in compression on the lateral side can be used to reduce the magnitude and rate of rearfoot supination. An individual having a profound anatomical condition such as varus or valgus, an individual who dramatically pronates or supinates, or an individual who has a history of injury would be prudent to consult with a trained medical doctor when contemplating modification to their articles of footwear.

It can be readily understood that with the use of a anterior spacer 55 positioned between anterior spring element 48 and posterior spring element 49, and a posterior spacer 42 positioned between the superior spring element 47 or posterior spring element 49 and the inferior spring element 50, that the configuration and functional relationship as between the forefoot area 58, midfoot area 67, and rearfoot area 68 of an article of footwear 22 can be adjusted and customized as desired by an individual wearer. Further, the use of a anterior spacer 55 and/or posterior spacer 42 having a select configuration can be used to adjust the amount of support provided by a superior spring element 47 or posterior spring element 49 which can possibly further include contours for mating with the complex curved shapes of a wearer's foot. For example, it is possible to customize the amount of support that is provided to the medial longitudinal, lateral longitudinal and transverse arches, and to the sides of a wearer's foot.

Figure 19:
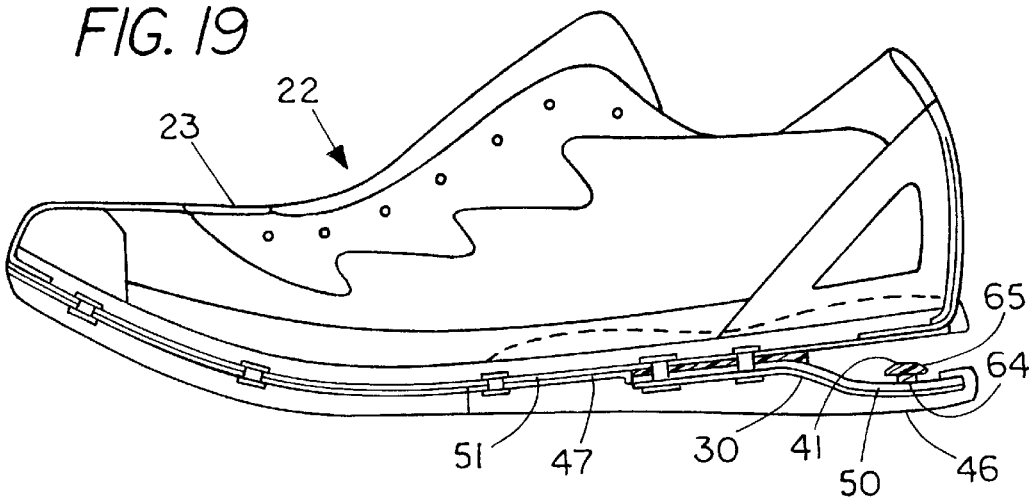
FIG. 19 is a side view of an alternate article of footwear generally similar to that shown in FIG. 18 further including a vibration decay time modifier.

FIG. 19 is a side view of an alternate article of footwear 22 having a posterior spacer 22 including a spring guard 40, and also a vibration decay time modifier 41 having a stem 64 and a head 65. The vibration decay time modifier 41 can be affixed in function relation to a portion of spring element 51, and in particular, a portion of an inferior spring element 50. The head 65 of the vibration decay time modifier 41 can be dimensioned and configured for vibration substantially free of contact with a spring element 51 in directions which substantially encompass a 360 degree arc and normal to the longitudinal axis of the stem 64, that is, when the vibration decay time modifier 41 is initially excited by shock and vibration. When the superior spring element 47 or posterior spring element 49 and inferior spring element 50 are subjected to compressive loading a vibration decay time modifier 41 can also serve as a stop and prevent any possible impact between these elements. The inclusion of a posterior spacer 42 and/or a vibration decay time modifier 41 can partially attenuate shock and vibration associated with impact events associated with movements such as walking or running, and can reduce the vibration decay time following an impact event. This can serve to enhance comfort, proprioception, reduce local trauma, and possibly solicit greater application of force and improved athletic performance.

Generally, the efficiency of a vibration decay time modifier will be enhanced the closer it is positioned in functional relation to a negative nodal point. When properly configured and placed proximate the negative nodal point of an object or implement, relatively little mass is required in order to substantially prevent, or alternately, to attenuate resonant vibration within fractions of a second. A negative nodal point is a point at which a substantial portion of the vibration energy in an excited object or implement will pass when it is excited by energy associated with an impact or other vibration producing event. Discussion of modes of vibration and negative nodal points can be found in Arthur H. Benade, *Fundamentals of Musical Acoustics*, 2nd edition, New York: Dover Publications, 1990, Harry F. Olson, *Music, Physics and Engineering*, 2nd edition, New York: Dover Publications, *1967*, and U.S. Pat. No. 3,941,380 granted to Francois Rene Lacoste on Mar. 2, 1976, this patent hereby being incorporated by reference herein. A technology taught by Steven C. Sims in U.S. Pat. No. 5,362,046, granted Nov. 4, 1994, this patent hereby being incorporated by reference herein, has been commercialized by Wilson Sporting Goods, Inc. into the SLEDGEHAMMER® INTUNE® tennis rackets, and by Hillerich and Bradsby Company, Inc. in the LOUISVILLE SLUGGER® SIMS STINGSTOP® aluminum baseball and softball bats, as well as the POWERBUILT® SIMS SHOCK RELIEF® golf club line. These products substantially eliminate the vibration and stinging associated with impact events experienced by a wielder's hands. Certain aspects of the aforementioned teachings can be applied in the present invention in order to accomplish a similar results with regards to an article of footwear 22 and the lower extremities of a wearer.

The source of shock and vibration can derive from a relatively controlled and harmonic movement, such as when a wearer repeatedly impacts the pavement while running in an article of footwear 22. Further, the source of shock and vibration can be random in nature, as when a wearer rides a wheeled vehicle such as a bicycle or motorcycle over rough terrain. Alternately, the source of shock and vibration can be constant and mechanically driven as when a wearer rides a bicycle, or a motor vehicle such as a motorcycle or snowmobile. A shock wave, that is, a shock pulse or discontinuity can travel at the speed of sound in a given medium. In the human body, the speed of sound in bone is approximately 3,200 meters/second, and in soft tissue approximately 1,600 meters/second. A shock wave traveling in a relatively dense fluid medium such as water has approximately five times the power that it does in a less dense fluid medium such as air. It is important to recognize that the human body is largely comprised of water and like fluid medium.

When a metal bell is struck, the bell will resonate and continue to ring for an extended time while the vibration energy is gradually dampened out. When a small bell is rung, one can place one's hand upon it and silence it. In that case, the primary dampening means for attenuating the resulting shock and vibration is the anatomy of the human subject. The same thing can happen when an impact event takes place as between an individual's foot and the materials which are used in an athletic shoe, and a running surface. When an individual runs on an asphalt surface in running shoes, the sound of the impact event that one hears is the audible portion of the shock wave that has been generated as result of the impact.

Many individuals know from experience that a vibrating implement or object can numb the hands. This is even more true when the source of the vibration is continuous and driven as when power equipment is being used. Associated with that numbness can be pain, reduced sensation and proprioception, and reduced muscular effort and performance as the body responds to protect itself from a perceived source of trauma and injury. Chronic exposure to high levels of vibration can result in a medical condition known as white finger disease. Generally, the lower extremities of most individuals are not subject to high levels of driven vibration. However, bicycle riders wearing relatively rigid articles of footwear can experience constant driven vibration, thus their feet can become numb or "go to sleep" over time. Motorcycle riders can also experience the same phenomenon.

The preferred article of footwear includes spring and dampening means for at least partially attenuating shock and vibration, that is, the initial shock pulse, pressure wave, or discontinuity and associated peak g's that are imparted to a wearer due to an impact event. At a cellular or molecular level, such vibration energy is believed to disturb normal functions such as blood flow in tendon tissue. Given appropriate engineering with respect to the characteristic or desired spring stiffness, mass, deflection, frequency, dampening, and percent transmissibility, an article of footwear of the present invention can partially attenuate shock and vibration. Viscous, friction, and mechanical dampening means can be used to attain this end. It is known that the mean power frequency associated with the rearfoot impact event in running generally corresponds to 20 Herz, and that of the forefoot to 5 Herz. The design and configuration, as well as the spring and dampening characteristics of a spring element 51, posterior spacer 42, and vibration decay time modifier 41 can be engineered so as to target these frequencies and provide a specific characteristic tuned mechanical response.

An anterior spacer 55, posterior spacer 42, and vibration decay time modifier 41 can be made of a cushioning medium such as a natural or synthetic rubber material, or a resilient elastomer such as polyurethane. In this regard, thermoset or thermoplastic materials can be used. Thermoplastic materials can be less expensive to produce as they can be readily injection molded. In contrast, thermoset materials are often compression molded using a relatively time and energy consuming vulcanization process. However, some thermoset materials can possess superior dampening properties and durability. Dampening materials which can be cured with the use of ultrasonic energy, microwave, visible or ultraviolet light, radio frequency, or other portions of the electromagnetic spectrum can be used. Room temperature cure elastomers, such as moisture or evaporation cure, or catalytic cure resilient materials can also be used. A suitable dampening material can be made of a butyl, chloroprene, polynorborene, neoprene, or silicone rubber, and the like. Alternately, a dampening material can be made of an elastomeric material such as polyurethane, or SORBOTHANE®. Suitable hybrid thermoplastic and rubber combinations can also be used, including dynamically vulcanized alloys which can be injection molded such as those produced by Advanced Elastomer Systems, 338 Main Street, Akron, Ohio 44311, e.g., SANTOPRENE®, VYRAM®, GEOLAST®, and TREFSIN®. SANTOPRENE® is known to consist of a combination of butyl rubber and ethylene-propylene. Generally, other materials developed for use in the audio industry for dampening vibration such as EAR ISODAMP®, SINATRA®, EYDEX®, and the like, or combinations thereof, can be used. Fillers such as organic or inorganic microspheres, carbon black or other conventional fillers can be used. Plasticizing agents such as fluids or oils can be used to modify the physical and mechanical properties of the dampening material in a desired manner. The preferred dampening material has transition characteristics suitable for the expected operational temperature of an article of footwear 22, and other physical and mechanical properties well suited to dampen shock and vibration and reduce vibration decay time.

It can be advantageous that the dampening material used to make a solitary vibration decay time modifier 41 including a stem 64 and a head 65 have a hardness in the range of 10–30 durometer, and preferably approximately 20 durometer on the Shore A scale. A relatively soft dampening material is capable a dampening a wide range of exciting vibration frequencies, and also relatively low vibration frequencies. However, a harder dampening material having greater shear and tear strength can sometimes be advantageous for use when making an anterior spacer 55 or posterior spacer 42 due to the magnitude of the loads which can be placed upon these components during use. A vibration decay time modifier 41 can be affixed to spring element 51 by conventional means such as adhesive, mechanically mating parts, chemical bonding, heat and pressure welding, radio. frequency welding, compression molding, injection molding, photocuring, and the like.

In a conventional article of footwear having a foam midsole and rubber outsole, the materials located between the wearer's foot and the inferior ground engaging surface of the outsole normally become compressed during footstrike and subsequent loading of the sole. During compressive loading the stiffness of these materials increases linearly or geometrically and as result the ability of the sole to dampen shock and vibration rapidly diminishes. Further, the area of the sole which transmits most of the shock and vibration can be relatively small and localized. In this regard, the energy associated with a shock pulse or discontinuity passes tends to pass quickly by the shortest route and through the hardest or stiffest material in which it is in communication. Again, the transmission of shock and vibration is extremely fast in the human body and the materials used in conventional articles of footwear. In a conventional article of footwear, the shock and vibration resulting from impact with the support surface is rapidly transmitted through the outsole, midsole, upper and insole and into a wearer's foot.

However, in the present invention the shock and vibration generated proximate the inferior ground engaging surface 53 of the outsole 43 must travel anteriorly along the outsole 43 and inferior spring element 50 before being transmitted to the superior spring element 47, upper 23 and wearer, thus for a greater distance relative to a conventional article of footwear. This affords more time and space in which to attenuate and dampen shock and vibration. Further, in the present invention the outsole 43 can be made of a softer material having better shock and vibration dampening characteristics than is normally the case in a conventional article of footwear. In addition, a posterior spacer 42 can serve as a shock and vibration isolator between the inferior spring element 50 and the superior spring element 47, upper 23, and wearer's foot. Moreover, as shown in FIGS. 19 and 20, at least one vibration decay time modifier 41 can be positioned in direct communication with inferior spring element 50 in order to dampen shock and vibration before it can be transmitted to a wearer. Accordingly, the present invention can provide a wearer with enhanced cushioning, shock and vibration isolation, and dampening effects relative to conventional footwear constructions.

FIG. 20 is a side view of an alternate article of footwear 22 including a posterior spacer 42 similar to that shown in FIG. 18. As shown in FIG. 20, a posterior spacer 42 can include a spring guard 40 and at least one protrusion which can be configured and engineered to serve as a vibration decay time modifier 41.

Figure 21:
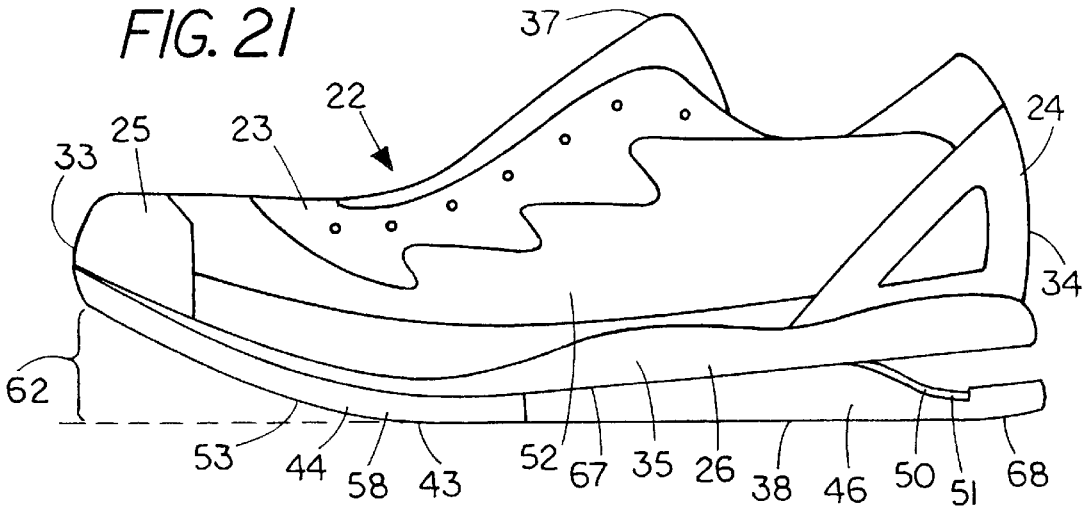
FIG. 21 is a side view of an alternate article of footwear similar to that shown in FIG. 4, but having various components affixed together with the use of adhesives.

FIG. 21 is a side view of an alternate article of footwear 22 generally similar to that shown in FIG. 1, but having various components including the upper 23, spring element 51, and outsole 43 affixed together with the use of adhesives in the manner of a conventional article of footwear.

Figure 22:
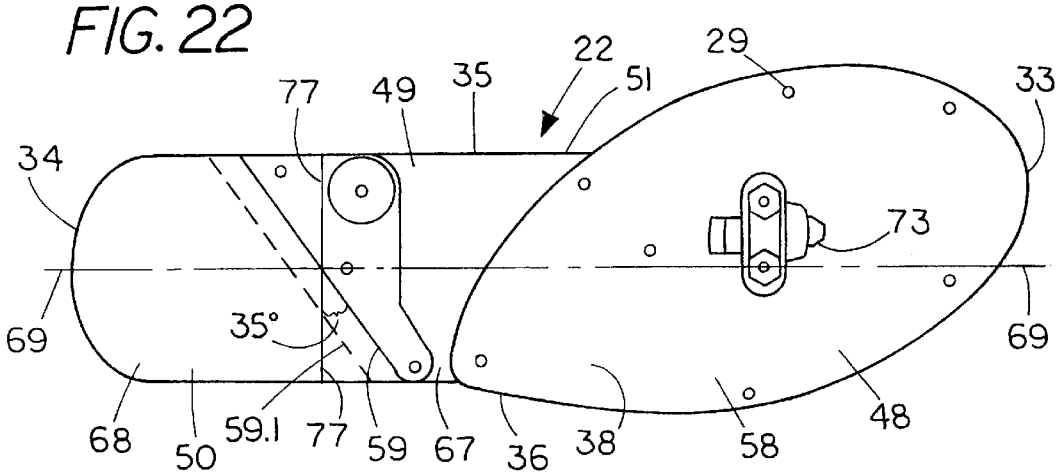
FIG. 22 is a bottom view of an alternate article of footwear similar to that shown in FIG. 3, having,spring element configured for accommodating a bicycle or skate cleat.

FIG. 22 is a bottom view of an alternate article of footwear 22 generally similar to that shown in FIG. 3, having a spring element 51 configured for accommodating a detachable bicycle cleat 73. The article of footwear 22 can then serve as bicycling shoe, and possibly also as a functional upper 23 for an in-line skate, as taught in the applicant's co-pending U.S. patent application Ser. No. 09/228,206 entitled "Weeled Skate With Step-In Binding And Brakes," hereby incorporated by reference herein.

Also shown in FIG. 22 is flexural axis 59, and with the use of a dashed line, an alternate position of flexural axis 59.1 with reference to the longitudinal axis 69. It can be readily understood that other more anterior or more posterior positions of a flexural axis 59 with reference to the longitudinal axis 69 are possible. The position of the flexural axis 59 can be selected in order to influence or determine the physical and mechanical properties of a spring element 51, and the overall conformance and performance of an article of footwear 22, as desired. However, it has been discovered that it is advantageous both with respect to the stability of the preferred article of footwear 22, but also the weight and cost of the spring element, that the posterior position of the flexural axis 59 on the medial side 35 be positioned approximately in the preferred range between 1–3 inches or 25.4–76.2 mm, and in particular, approximately in the range between 1.5–2.5 inches or 38.1–63.5 mm from the posterior side 34 of the upper 23 in a men's size 11.5 article of footwear 22. The method of grading and scaling various footwear components for other men's or women's sizes is well known in the footwear industry, thus the preferred range as concerns the position of the flexural axis 59 on the medial side 32 can be determined from this information for any given size article of footwear 22.

It can be readily understood that this teaching concerning the preferred position of the flexural axis 59 with reference to the longitudinal axis 69 can be applied to other embodiments of a preferred article of footwear 22. Moreover, possible angular deviation of the flexural axis 59 from the transveres axis 77 in the range between 10–50 degrees was previously discussed. One advantage to using a flexural axis 59 that is deviated from the transveres axis 77 in the range between 10–50 degrees is that it permits the use of an inferior spring element 50 having a relatively homogenous construction and a substantially uniform thickness, and this both serves to reduce manufacturing costs and enhances product reliability. It can be readily understood that various combinations with respect to the position of the flexural axis 59 with reference to the longitudinal axis 69 and the angular deviation of the flexural axis 59 from the transveres axis 77 can be functional.

Figure 23:
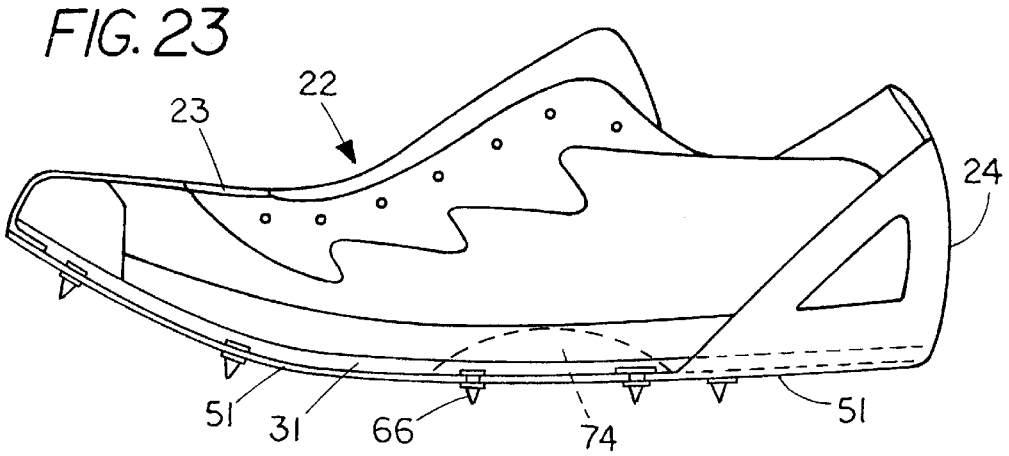
FIG. 23 is a side view of an alternate article of footwear generally similar to that shown in FIG. 17, but including a spring element which extends about the heel to form an integral heel counter, and about the lateral side of the forefoot to form a side support, with the outsole and inferior spring element removed, and including track spike elements.

FIG. 23 is a side view of an alternate article of footwear 22 generally similar to that shown in FIG. 17, but having the anterior outsole element 44, posterior outsole element 46, and inferior spring element 50 removed, and further including track spike elements 66. This embodiment can facilitate enhanced athletic performance and can be used by track and field athletes in the sprinting and jumping events. Further, the spring element 51 can extend upwards about the area of the heel to form an integral heel counter 24, as shown in FIG. 23. In addition, the spring element 51 can extend upwards about the lateral side 36 of the forefoot area 58 to form a side support 74, as shown with dashed lines in FIG. 23. Various configurations of a side support 74 and/or an integral heel counter 24 can be incorporated in any or all embodiments of a preferred article of footwear 22, as desired. Moreover, the superior spring element 47 used in any or all embodiments of a preferred article of footwear 22 can be configured to mate with or otherwise support the complex curved shapes and structures associated with the anatomy of the human foot.

Figure 24:
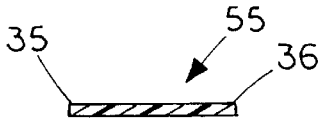
FIG. 24 is a cross sectional view of the anterior spacer included in the article of footwear shown in FIG. 8, taken along line 24—24.

FIG. 24 is a cross sectional view of the anterior spacer 55 included in the article of footwear 22 shown in FIG. 8, taken along line 24—24. As shown in FIG. 24, the anterior spacer 55 has a uniform elevation.

Figure 25:
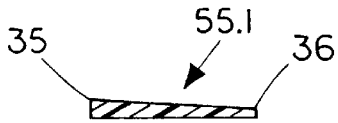
FIG. 25 is a cross sectional view of an alternate anterior spacer generally similar to that shown in FIG. 8, but having a wedge shape, taken along a line consistent with line 24—24.

FIG. 25 is a cross sectional view of an alternate anterior spacer 55.1 generally similar to that shown in FIG. 8, but having a wedge shape 28, taken along a line consistent with line 24—24. As shown in FIG. 25, the anterior spacer 55.1 has a wedge shape 28 which slopes upward from the lateral side 36 to the medial side 35.

Figure 26:
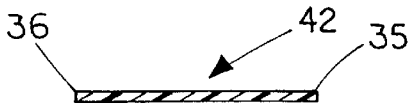
FIG. 26 is cross sectional view of the posterior spacer included in the article of footwear shown in FIG. 9, taken along line 26—26.

FIG. 26 is a cross sectional view of the posterior spacer 42 included in the article of footwear 22 shown in FIG. 9, taken along line 26—26. As shown in FIG. 26, the posterior spacer 42 has a uniform elevation.

Figure 27:
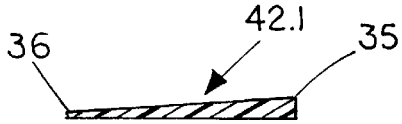
FIG. 27 is a cross sectional view of an alternate posterior spacer generally similar. to that shown in FIG. 9, but having a wedge shape, taken along a line consistent with line 26—26.

FIG. 27 is a cross sectional view of an alternate posterior spacer generally similar to that shown in FIG. 9, but having a wedge shape, taken along a line consistent with line 26—26. As shown in FIG. 27, the posterior spacer 42.1 has a wedge shape 28 which slopes upward from the lateral side 36 to the medial side 35.

FIGS. 24–27 have been provided to illustrate a few of the possible configurations of an anterior spacer 55 and posterior spacer 22, and other variations are both possible and anticipated. For example, the configuration and. slope of the wedge shapes 28 can be the opposite of that represented, and the anterior spacer 55 and/or posterior spacer 22 can slope upwards from the medial side 35 to the lateral side 36. Further, the anterior spacer 55 and/or posterior spacer 22 can have more complex or compound curved shapes. In addition, it can be readily understood that the amount of elevation and/or degree of slope of the anterior spacer 55 and/or posterior spacer 42 can be varied. The compressive, flexural and torsional stiffness of different anterior spacer 55 and/or posterior spacer 42 can also be varied. Moreover, an anterior spacer 55 and/or posterior spacer can be made to exhibit differential stiffness in different portions.

Again, an anterior spacer 55 or posterior spacer 42 can also have a wedge or complex curved shape along the longitudinal axis 69, that is, in the posterior to anterior orientation, and various configurations can be provided which can be used to modify the overall conformance of a spring element 51 and article of footwear 22, as desired. Accordingly, many variables can be manipulated and selected to optimize the configuration and performance of a preferred article of footwear for an individual wearer, or for a given target population having similar characteristics and requirements.

Figure 28:
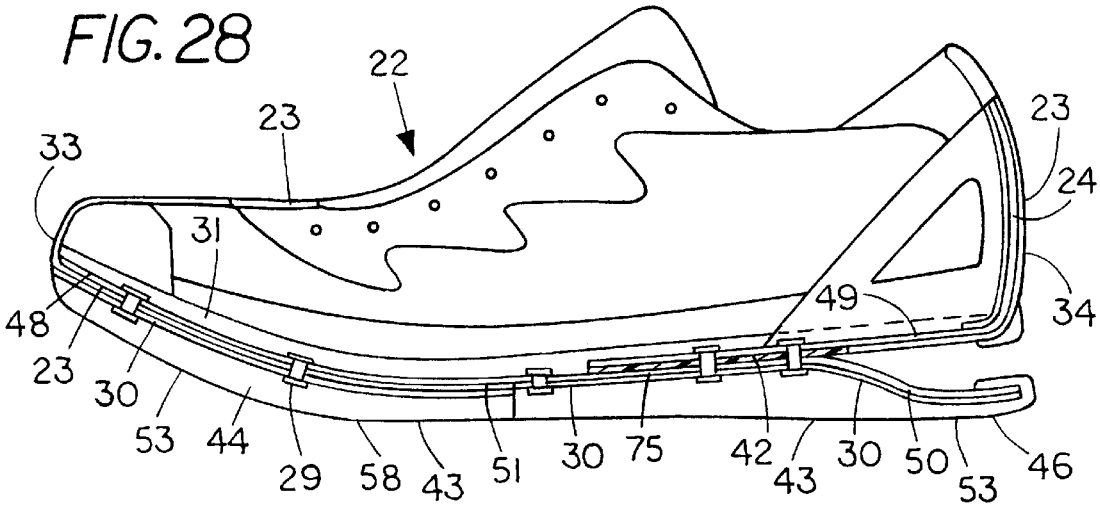
FIG. 28 is a side view of an alternate article of footwear having an alternate spring element with parts broken away.

FIG. 28 is a side view of an alternate article of footwear 22 having a different configuration of a spring element 51, with parts broken away. In this embodiment, the anterior spring element 48 and inferior spring element 50 can be affixed in functional relation with the use of mechanical means such as fasteners 29, and the like, or alternately be formed as a single component identified herein as anterior and inferior spring element 75. The anterior portion of the spring element 51 can pass through a slit in the t-sock 56 or upper 23 and then be affixed with fasteners 29 to outsole 43, thereby firmly securing the upper 23 in functional relation thereto. As shown, the posterior spring element 49 can be affixed to the posterior portion of the spring element 51 with fasteners 29, and a posterior spacer 42 can also be inserted therebetween. Alternately, the posterior spacer 42 be formed as a coating or otherwise consist of a portion of the t-sock 56 or upper 23. As shown in FIG. 28, the posterior spring element 49 can be made to further include an integral heel counter 24.

Figure 29:
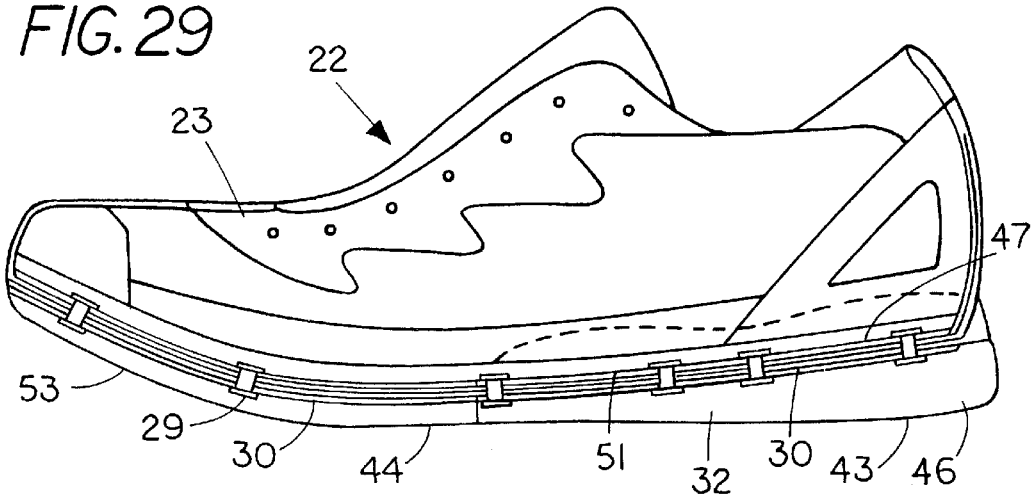
FIG. 29 is a side view of an alternate article of footwear having a spring element, and a selectively removable sole.

FIG. 29 is a side view of an alternate article of footwear 22 having a spring element 51, and a selectively removable sole 32. The sole 32 can include separate midsole 26 and outsole 43 components, or can be made as a single component. Various sole 32 components can be made having different physical and mechanical characteristics, and performance capabilities for possible selection and use by a wearer. The sole 32 can be selectively removed and replaced by a wearer in order to customize the article of footwear 22, or to renew a component, as desired. As shown in FIG. 29, the spring element 51 does not include an inferior spring element 50, rather the spring element 51 consists of a superior spring element 47, or an anterior spring element 48 and posterior spring element 49 which are affixed in functional relation.

While the above detailed description of the invention contains many specificities, these should not be construed as limitations on the scope of the invention, but rather as exemplifications of several preferred embodiments thereof. Many other variations are possible. Accordingly, the scope of the invention should be determined not by the embodiments discussed or illustrated, but by the appended claims and their legal equivalents.

I claim:

1. An article of footwear having an anterior side, a posterior side, a medial side, a lateral side, a longitudinal axis, and a transverse axis, comprising an upper, a sole, at least one fastener, and a spring element comprising a superior spring element and an inferior spring element, said superior spring element extending substantially between said posterior side and said anterior side of said article of footwear and substantially positioned within said upper, said inferior spring element and said sole substantially positioned interiorly and externally with respect to said upper, said superior spring element affixed in functional relation to said inferior spring element by said at least one fastener thereby securing said upper in functional relation therebetween.

2. The article of footwear according to claim 1, wherein said superior spring element further comprises an anterior spring element and a posterior spring element affixed together in functional relation.

3. The article of footwear according to claim 2, wherein said anterior spring element comprises a thickness in the range between 1.0–2.0 mm, and said posterior spring element comprises a thickness in the range between 2.0 and 4.0 mm.

4. The article of footwear according to claim 2, wherein said anterior spring element and said posterior spring element are affixed in functional relation in an overlapping relationship.

5. The article of footwear according to claim 2, wherein said inferior spring element is affixed in functional relation to said posterior spring element.

6. The article of footwear according to claim 1, wherein said superior spring element and said inferior spring element are configured and affixed in functional relation forming a v-shape.

7. The article of footwear according to claim 1, wherein said inferior spring element is affixed in functional relation to said superior spring element and projects rearward and downward therefrom, and said inferior spring element further comprises a flexural axis deviated from said transverse axis in the range between 10 and 50 degrees.

8. The article of footwear according to claim 7, a wherein posterior of said flexural axis the posterior to anterior lengths of said superior spring element and said inferior spring element are less on said medial side than on said lateral side, and the posterior most position of said flexural axis on said medial side is in the range between 1–3 inches from said posterior side of said upper.

9. The article of footwear according to claim 1, further including a spring guard.

10. The article of footwear according to claim 1, further including a posterior spacer.

11. The article of footwear according to claim 1, further including an anterior spacer.

12. The article of footwear according to claim 1, further including a vibration decay time modifier.

13. The article of footwear according to claim 1, wherein said superior spring element is substantially planar.

14. The article of footwear according to claim 1, wherein said superior spring element further comprises a heel counter.

15. The article of footwear according to claim 1, wherein said upper, said sole, said spring element, and said at least one fastener are readily selectively removable.

16. The article of footwear according to claim 1, said upper further comprising a sleeve for affixing at least a portion of said superior spring element in function relation thereto.

17. The article of footwear according to claim 1, wherein said spring element comprises a fiber composite material.

18. The article of footwear according to claim 1, wherein said superior spring element comprises a thickness in the range between 1.0 and 4.0 mm, and said inferior spring element comprises a thickness in the range between 2.0 and 4.0 mm.

19. The article of footwear according to claim 1, wherein said spring element comprises metal.

20. The article of footwear according to claim 2, wherein said posterior spring element further comprises a projection, and said anterior spring element and said posterior spring element are affixed in functional relation in an overlapping relationship.

21. The article of footwear according to claim 1, wherein said anterior spring element is curved.

22. The article of footwear according to claim 1, wherein said inferior spring element is substantially positioned posterior of 50 percent of the length between said posterior side and said anterior side and affixed in functional relation to said superior spring element and projects rearward and downward therefrom forming a V-shape, said inferior spring element comprising a transverse axis and comprising greater length posterior of said transverse axis on said lateral side than on said medial side, said inferior spring element comprising greater concavity downwards adjacent said transverse axis on said medial side than on said lateral side.

23. The article of footwear according to claim 1, wherein said spring element stores and returns at least 70 percent of the energy imparted thereto.

24. The article of footwear according to claim 1, wherein said sole comprises a backing and an outsole.

25. The article of footwear according to claim 1, wherein said sole comprises an anterior outsole element and a posterior outsole element, and said anterior outsole element is affixed in functional relation to said superior spring element, and said posterior outsole element is affixed to said inferior spring element.

26. An article of footwear having an anterior side, a posterior side, a medial side, a lateral side, a longitudinal axis, a transverse axis, a forefoot area, a midfoot area, and a rearfoot area, comprising an upper, a sole, at least one fastener, and a spring element comprising a superior spring element and an inferior spring element, said superior spring element comprising a thickness in the range between 1–4 mm and said inferior spring element comprising a thickness in the range between 2–4 mm, said superior spring element extending substantially between said posterior side and said anterior side of said article of footwear and substantially positioned within said upper, said inferior spring element and said sole substantially positioned interiorly and externally with respect to said upper, said inferior spring element affixed in functional relation to said superior spring element by said at least one fastener thereby securing said upper in functional relation therebetween, said upper, said superior spring element, said inferior spring element, said sole, and said at least one fastener being readily selectively removable, said superior spring element further comprising an anterior spring element and a posterior spring element affixed in functional relation, a substantial portion of said anterior spring element extending anterior of 70 percent of the length of said upper as measured from said posterior side of said upper, said inferior spring element affixed in functional relation to said posterior spring element and projecting rearward and downward therefrom forming a v-shape, a substantial portion of said inferior spring element extending within 50 percent of the length of said upper as measured from said posterior side of said upper, said inferior spring element further comprising a flexural axis deviated from said transverse axis in the range between 10 and 50 degrees, and posterior of said flexural axis the posterior to anterior length of said posterior spring element and said inferior spring element is less on said medial side than on said lateral side, and the posterior most position of said flexural axis on said medial side is in the range between 1–3 inches from said posterior side of said upper, and said spring element in conjunction with said article of footwear provides deflection in said rearfoot area in the range between 8–15 mm.

27. An article of footwear having an anterior side, a posterior side, a medial side, a lateral side, a longitudinal axis, and a transverse axis, comprising a spring element comprising a superior spring element and an inferior spring element, said superior spring element extending substantially between said posterior side and said anterior side of said article of footwear, said inferior spring element substantially positioned within 50 percent of the length between said posterior side and said anterior side and affixed in functional relation to said superior spring element and projecting rearward and downward therefrom forming a V-shape, said inferior spring element comprising a transverse axis and comprising greater length posterior of said transverse axis on said lateral side than on said medial side, said inferior spring element comprising greater concavity downwards adjacent said transverse axis on said medial side than on said lateral side.

28. The article of footwear according to claim 27, said inferior spring element being concave upwards adjacent said posterior side.

29. The article of footwear according to claim 27, said inferior spring element comprising maximum separation from said superior spring element at a position anterior of the posterior side of said inferior spring element, said inferior spring element substantially maintaining said maximum separation between said position and said posterior side of said inferior spring element.

30. An article of footwear having an anterior side, a posterior side, a medial side, a lateral side, a longitudinal axis, and a transverse axis, comprising a spring element comprising a superior spring element and an inferior spring element, said inferior spring element substantially positioned within 50 percent of the length between said posterior side and said anterior side and affixed in functional relation to said superior spring element and projecting rearward and downward therefrom forming a V-shape, said inferior spring element comprising a transverse axis and comprising greater length posterior of said transverse axis on said lateral side than on said medial side, said inferior spring element comprising greater concavity downwards adjacent said transverse axis on said medial side than on said lateral side.

* * * * *

UNITED STATES PATENT AND TRADEMARK OFFICE

CERTIFICATE OF CORRECTION

PATENT NO. : 6,449,878 B1
DATED : September 17, 2002
INVENTOR(S) : Robert M. Lyden It is certified that error appears in the above-identified patent and that said Letters Patent is hereby corrected as shown below:

Title page,
Item [56], References Cited, FOREIGN PATENT DOCUMENTS, please add
-- Germany 1,808,245 --
U.S. PATENT DOCUMENTS, change "D731,898" to -- D431,898 --.
Please add the following patent 4,492,046 Kosova in class 36, subclass 27.
Item [57], ABSTRACT,
Line 12, after "forefoot", insert -- , --, and after "midfoot" insert -- , and rearfoot --.

Column 14,
Line 16, cancel "at constent", and insert -- consistent --.

Column 19,
Line 10, cancel "of", and cancel "transverses", and insert -- transverse --;
Line 12, cancel "transveres", and insert -- transverse --.

Column 21,
Line 35, cancel "transveres", and insert -- transverse --.

Column 28,
Lines 48, 50 and 58, cancel "transveres", and insert -- transverse --.

Column 30,
Line 44, cancel "interiorly", and insert -- inferiorly --.

Column 31,
Line 7, cancel "a".

Signed and Sealed this

Thirtieth Day of September, 2003

JAMES E. ROGAN
*Director of the United States Patent and Trademark Office*